US011221175B1

(12) United States Patent
Bardouche et al.

(10) Patent No.: US 11,221,175 B1
(45) Date of Patent: Jan. 11, 2022

(54) LINER HANGER

(71) Applicant: Sub-Zero Group, Inc., Madison, WI (US)

(72) Inventors: Kari Ann Bardouche, Madison, WI (US); Sean T. Petersen, Evansville, WI (US); Hans Vanden Berg, Black Earth, WI (US)

(73) Assignee: Sub-Zero Group, Inc., Madison, WI (US)

( * ) Notice: Subject to any disclaimer, the term of this patent is extended or adjusted under 35 U.S.C. 154(b) by 0 days.

(21) Appl. No.: 17/219,441

(22) Filed: Mar. 31, 2021

Related U.S. Application Data

(60) Provisional application No. 63/127,538, filed on Dec. 18, 2020.

(51) Int. Cl.
*F25D 23/06* (2006.01)

(52) U.S. Cl.
CPC ..... *F25D 23/067* (2013.01); *F25D 23/063* (2013.01); *F25D 23/066* (2013.01)

(58) Field of Classification Search
CPC .... F25D 23/065; F25D 23/066; F25D 23/067; F25D 23/06; F25D 23/062; F25D 23/063
See application file for complete search history.

(56) References Cited

U.S. PATENT DOCUMENTS 3,378,957 A * 4/1968 Frehse ..... F25D 23/087 49/478.1
4,134,627 A * 1/1979 Kuskowski ..... F25D 23/085 312/236
4,955,676 A 9/1990 Weaver et al.
5,034,861 A 7/1991 Skelnak et al.
5,287,252 A 2/1994 Caruso
5,348,485 A 9/1994 Briechle et al.
5,584,551 A 12/1996 Jenkins
5,720,536 A * 2/1998 Jenkins ..... F25D 23/085 312/401

(Continued)

FOREIGN PATENT DOCUMENTS

EP 2844935 B1 4/2013
EP 2267363 B1 1/2015

(Continued)

OTHER PUBLICATIONS

Spring-Loaded Connectors/Pogo pins connectors, Product Listing, 2 pages. Printed from the internet: http://www.precipid.com/AppHost/9695.1/Scripts/Modules/Catalog/Default.aspx?c=11, Jan. 22, 2019.

*Primary Examiner* — Daniel J Rohrhoff
(74) *Attorney, Agent, or Firm* — Bell & Manning, LLC

(57) ABSTRACT

A liner hanger includes a body wall, a first hook wall, a second hook wall, a brace wall, and an abutment wall. The body wall includes a first face and a second face. The second face is on an opposite side of the body wall relative to the first face. The first hook wall is mounted to the first face of the body wall to form a first hook channel. The second hook wall is mounted to the second face of the body wall to form a second hook channel. The brace wall includes a first end and a second end. The second end is on an opposite end of the brace wall relative to the first end. The first end is mounted to the first face of the body wall. The abutment wall is mounted to the second end of the brace wall.

20 Claims, 25 Drawing Sheets

(56) References Cited

U.S. PATENT DOCUMENTS

| | | | | |
|---|---|---|---|---|
| 5,992,960 | A * | 11/1999 | Wolanin | F25D 21/04 312/265.5 |
| 6,056,383 | A * | 5/2000 | Banicevic | F25D 23/082 312/401 |
| 6,065,821 | A | 5/2000 | Anderson et al. | |
| 6,435,697 | B1 | 8/2002 | Simmons et al. | |
| 6,813,896 | B1 | 11/2004 | Janke et al. | |
| 7,108,341 | B2 | 9/2006 | Myers et al. | |
| 7,293,848 | B2 | 11/2007 | Myers et al. | |
| 7,871,176 | B2 | 1/2011 | Kelly et al. | |
| 7,954,979 | B2 | 6/2011 | Sommers et al. | |
| 8,128,251 | B2 | 3/2012 | Huang et al. | |
| 8,646,935 | B2 | 2/2014 | Karan | |
| 9,287,021 | B2 | 3/2016 | Hammond et al. | |
| 9,455,506 | B2 | 9/2016 | Kerner | |
| 9,541,328 | B2 | 1/2017 | Kerner | |
| 9,719,719 | B2 | 8/2017 | Kerner | |
| 9,989,298 | B1 | 6/2018 | Wantland et al. | |
| 2010/0135020 | A1* | 6/2010 | Moore | A47F 11/10 362/249.02 |
| 2010/0270925 | A1 | 10/2010 | Billy | |
| 2013/0155669 | A1 | 6/2013 | Lee et al. | |
| 2014/0022790 | A1 | 1/2014 | Wang | |
| 2014/0376213 | A1 | 12/2014 | Miedema et al. | |
| 2016/0161669 | A1 | 6/2016 | Lee | |
| 2017/0191743 | A1 | 7/2017 | Lee | |
| 2018/0266752 | A1* | 9/2018 | Mizuno | F25D 17/04 |

FOREIGN PATENT DOCUMENTS

| | | | |
|---|---|---|---|
| EP | 2916088 | A1 | 9/2015 |
| WO | WO2014/205352 | | 12/2014 |

* cited by examiner

LINER HANGER

CROSS-REFERENCE TO RELATED APPLICATIONS

The present application claims the benefit of and priority under 35 U.S.C. § 119(e) to U.S. Provisional Patent Application No. 63/127,538 filed on Dec. 18, 2020, the entire contents of which is hereby incorporated by reference.

BACKGROUND

Insulating foam may be blown or poured between an exterior wall of a container and an interior wall of the container to provide an insulated wall. For example, a refrigerator includes an exterior wall or shell and an interior wall or liner each of which may or may not be visible to the consumer. Insulating foam is blown into a space formed between the exterior wall and the interior wall. The interior wall should be positioned and secured at a correct depth relative to the exterior wall for proper application of the insulating foam there between.

SUMMARY

In an example embodiment, a liner hanger is provided. The liner hanger includes, but is not limited to, a body wall, a first hook wall, a second hook wall, a brace wall, and an abutment wall. The body wall includes, but is not limited to, a first face and a second face. The second face is on an opposite side of the body wall relative to the first face. The first hook wall is mounted to the first face of the body wall to form a first hook channel. The second hook wall is mounted to the second face of the body wall to form a second hook channel. The brace wall includes, but is not limited to, a first end and a second end. The second end is on an opposite end of the brace wall relative to the first end. The first end is mounted to the first face of the body wall. The abutment wall is mounted to the second end of the brace wall.

In another example embodiment, an insulated wall is provided. The insulated wall includes, but is not limited to, a first wall configured to form a first hook channel, a second wall configured to form a second hook channel, a third wall, the liner hanger, and insulating foam mounted between the first wall, the second wall, and the third wall surrounding the liner hanger.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
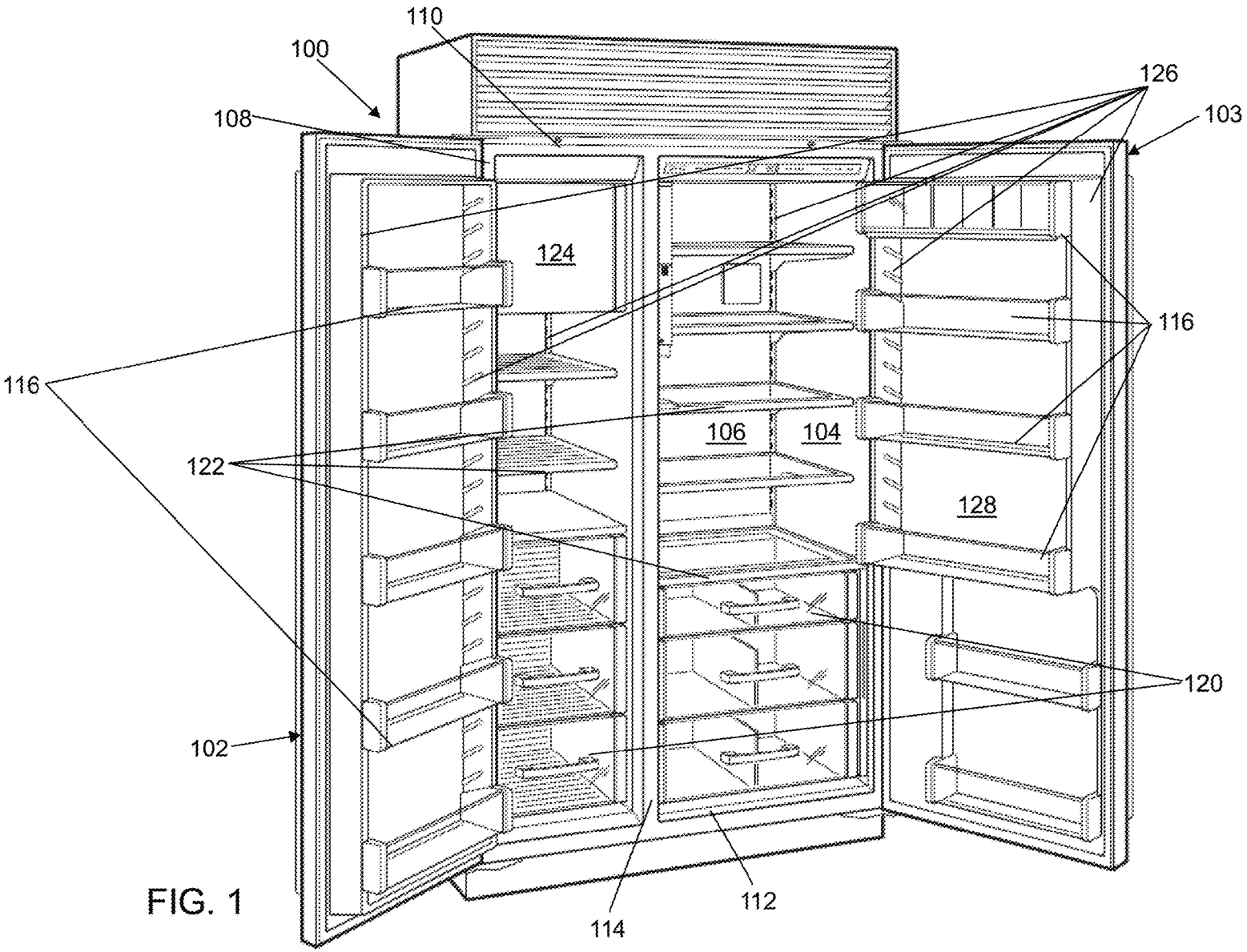
FIG. 1 depicts a left, front perspective view of a refrigerator in accordance with an illustrative embodiment.

Referring to FIG. 1, a left, front, perspective view of a refrigerator 100 is shown in accordance with an illustrative embodiment. Refrigerator 100 may include a one or more compartments or cooling zones. Refrigerator 100 may include a freezer compartment door 102, a refrigerator compartment door 103, a right side wall 104, a back wall 106, a left side wall 108, a top wall 110, a bottom wall 112, and a divider wall 114. In the illustrative embodiment, freezer compartment door 102 is rotatably mounted to top wall 110 and bottom wall 112 adjacent left side wall 108 using two hinges, and refrigerator compartment door 103 is rotatably mounted to top wall 110 and bottom wall 112 adjacent right side wall 104 using another two hinges. In alternative embodiments, freezer compartment door 102 and/or refrigerator compartment door 103 may be rotatably mounted to different walls of refrigerator 100 using a fewer or a greater number of hinges.

Freezer compartment door 102 provides access to a freezer compartment defined by top wall 110, left side wall 108, bottom wall 112, back wall 106, divider wall 114, and freezer compartment door 102 when freezer compartment door 102 is in a closed position. Refrigerator compartment door 103 provides access to a refrigerated compartment defined by top wall 110, right side wall 104, bottom wall 112, back wall 106, divider wall 114, and refrigerator compartment door 103 when refrigerator compartment door 103 is in a closed position.

Divider wall 114 separates the freezer compartment from the refrigerator compartment. In the illustrative embodiment, divider wall 114 extends vertically between top wall 110 and bottom wall 112. Of course, in alternative embodiments, divider wall 114 may extend horizontally to separate the two compartments with the freezer compartment either above or below the refrigerated compartment. Additionally, in alternative embodiments, the locations of the freezer compartment and the refrigerated compartment may be reversed. Further, refrigerator 100 may include a greater or a fewer number of compartments in various arrangements horizontally or vertically with respect to each other.

Though shown in the illustrative embodiment as forming a generally rectangular shaped enclosure, refrigerator 100 may form any shaped enclosure including other polygons as well as circular or elliptical enclosures. As a result, freezer compartment door 102, refrigerator compartment door 103, and the walls forming refrigerator 100 may have any shape including other polygons as well as circular or elliptical shapes.

Various storage devices may be housed within the enclosed space(s) of refrigerator 100. For example, zero or more drawers 120, shelves 122, or other receptacles may be mounted within the freezer compartment and the refrigerator compartment. An ice maker/dispenser 124 may be mounted within the freezer space to make and store ice. Zero or more door shelves 116 may be mounted to either or both of freezer compartment door 102 and refrigerator compartment door 103.

The storage devices may mount to various walls of refrigerator 100, to freezer compartment door 102, and/or to refrigerator compartment door 103 using one or more ladders 126 that are mounted to a wall of refrigerator 100, a wall of freezer compartment door 102, or a wall of refrigerator compartment door 103. For example, a right mounting ladder and a left mounting ladder of the one or more ladders 126 may be mounted to an interior door plate 128 of refrigerator compartment door 103. The one or more ladders 126 may be configured so that a mounting mechanism of a respective drawer, shelf, or other receptacle is attached to a rung of the ladder or between a pair of ladder rungs as understood by a person of skill in the art. For example, the mounting mechanism may include a hook that is mounted to the storage device and over a rung of the ladder or between a pair of ladder rungs to position the storage device within the enclosed space, on freezer compartment door 102, or on refrigerator compartment door 103. As another example, the mounting mechanism may include a pin that is mounted to the storage device and inserted in a rung of the ladder or between a pair of ladder rungs to position the storage device within the enclosed space, on freezer compartment door 102, or on refrigerator compartment door 103. As yet another example, the mounting mechanism may include an aperture that is mounted to the storage device and to a pin mounted as a rung of the ladder to position the storage device within the enclosed space, on freezer compartment door 102, or on refrigerator compartment door 103. Other mounting mechanisms may be used such as adhesive, soldering, etc. Zero or more of the storage devices may be mountable to different ladder rungs to change a position of the storage container within the enclosed space, on freezer compartment door 102, or on refrigerator compartment door 103.

A temperature of one or more refrigerated compartments of refrigerator 100 may be maintained at an adequate temperature to preserve fresh food using a refrigeration system (not shown) as understood by a person of skill in the art, and a temperature of one or more freezer compartments may be maintained at an adequate temperature to maintain food stored therein in a frozen state using a second refrigeration system (not shown) as understood by a person of skill in the art.

A refrigerator controller (not shown) may control a flow of refrigerant through each refrigeration system of refrigerator 100. Refrigerator 100 may include one or more refrigeration systems. Refrigeration system components, such as a compressor, a condenser, an evaporator, a dryer, etc., may be mounted to various walls of refrigerator 100 either within the walls, on an exterior of the walls relative to refrigerator 100, and/or on an interior of the walls relative to refrigerator 100.

Use of directional terms, such as top, bottom, right, left, front, back, etc. are merely intended to facilitate reference to the various surfaces and elements of the described structures relative to the orientations shown in the drawings and are not intended to be limiting in any manner. For consistency, the components of refrigerator 100 are labeled such that freezer compartment door 102 and refrigerator compartment door 103 define a front of refrigerator 100.

As understood by a person of skill in the art, the walls that form refrigerator 100 are insulated walls that include insulation to assist in maintenance of the desired temperature in the freezer and refrigerator compartments. Electrical wiring and various conduits may further be located in the insulated walls. For example, during a manufacturing process, a space between exterior walls of refrigerator 100 and an interior liner are filled with an insulating foam material that provides insulation. Freezer compartment door 102 and refrigerator compartment door 103 further may include insulated walls.

Figure 2:
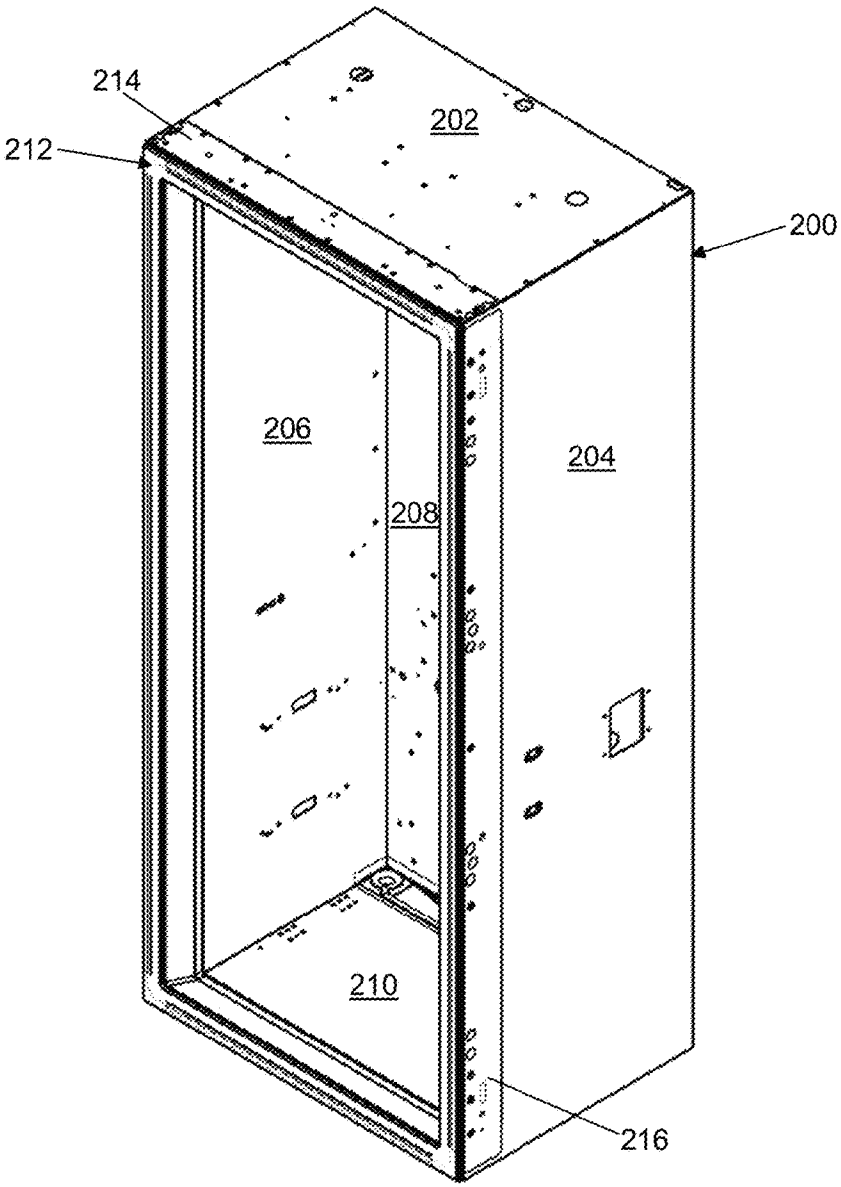
FIG. 2 depicts a right, front perspective view of a cabinet of a refrigerator in accordance with an illustrative embodiment.

Referring to FIG. 2, a right, front perspective view of a cabinet 200 of a refrigerator is shown in accordance with an illustrative embodiment. Cabinet 200 may be part of refrigerator 100, such as the freezer compartment or the refrigerated compartment, or a stand-alone compartment that may be used as a freezer or refrigerated compartment.

Figure 4:
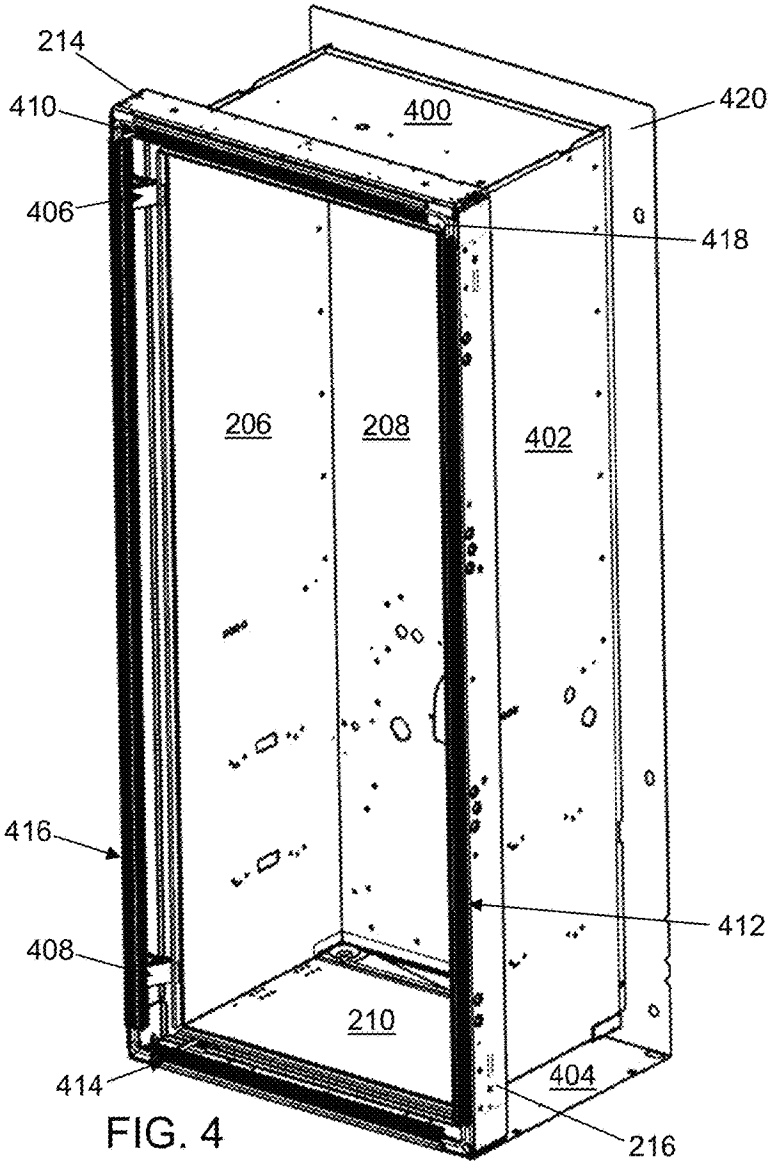
FIG. 4 depicts a right, front perspective view of the cabinet of FIG. 2 with the shell of FIG. 3 removed in accordance with an illustrative embodiment.
Figure 3:
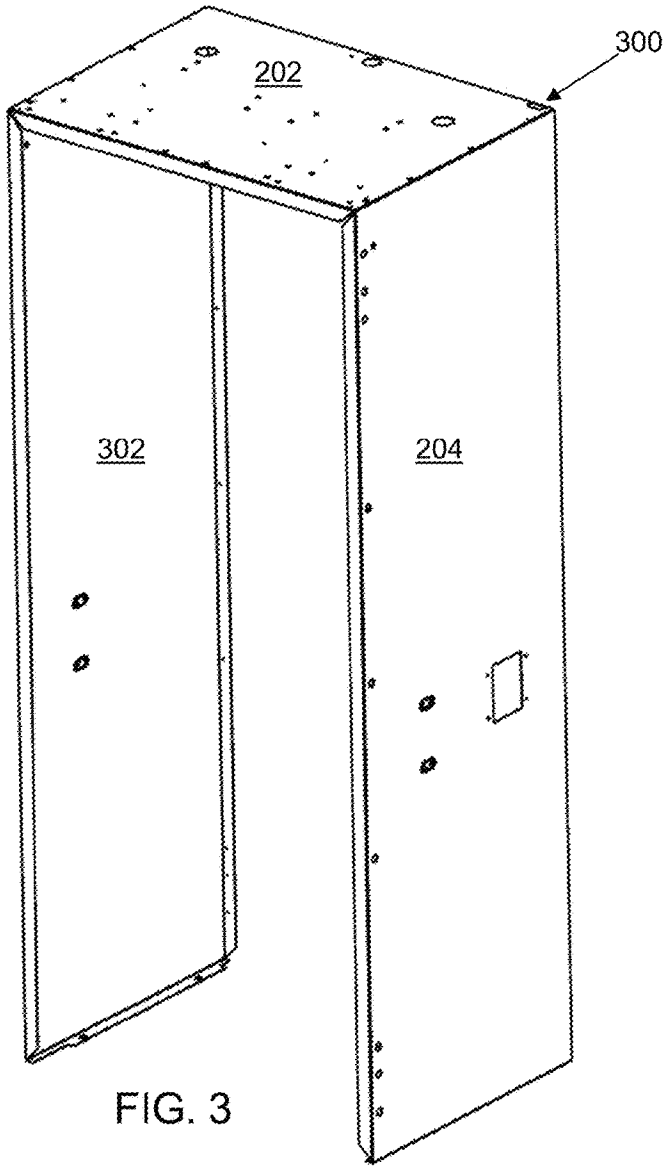
FIG. 3 depicts a right, front perspective view of a shell of the cabinet of FIG. 2 in accordance with an illustrative embodiment.
Figure 6:
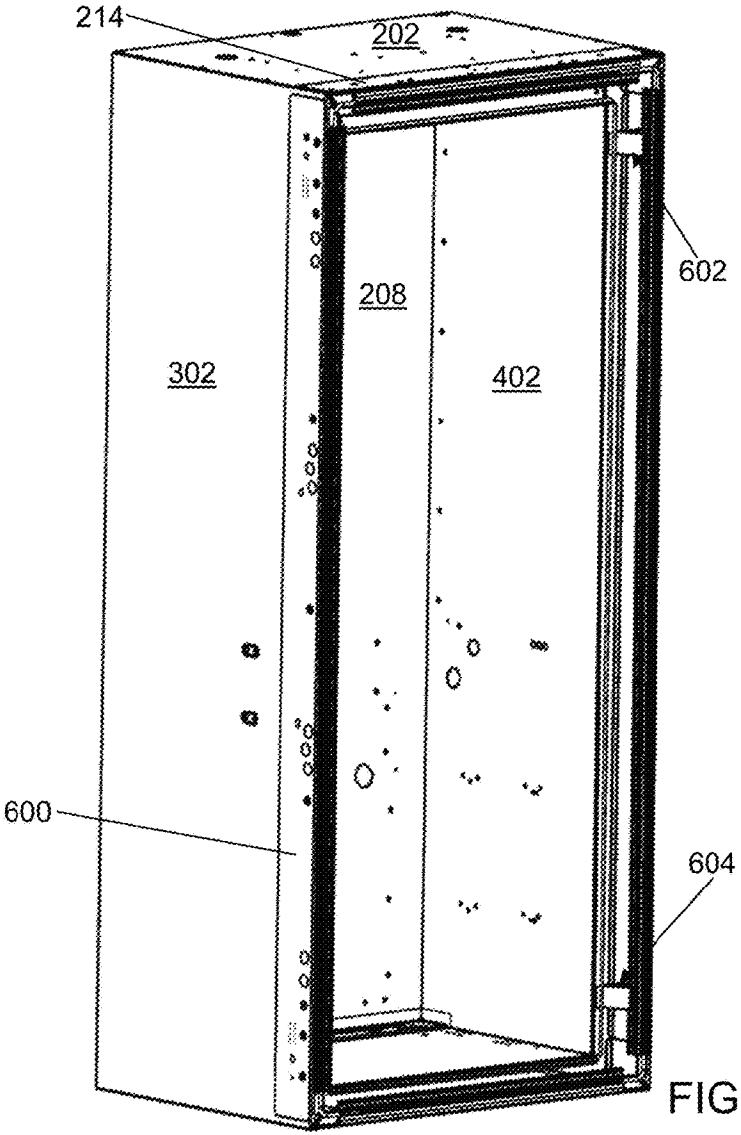
FIG. 6 depicts a left, front perspective view of the cabinet of FIG. 5 in accordance with an illustrative embodiment.
Figure 5:
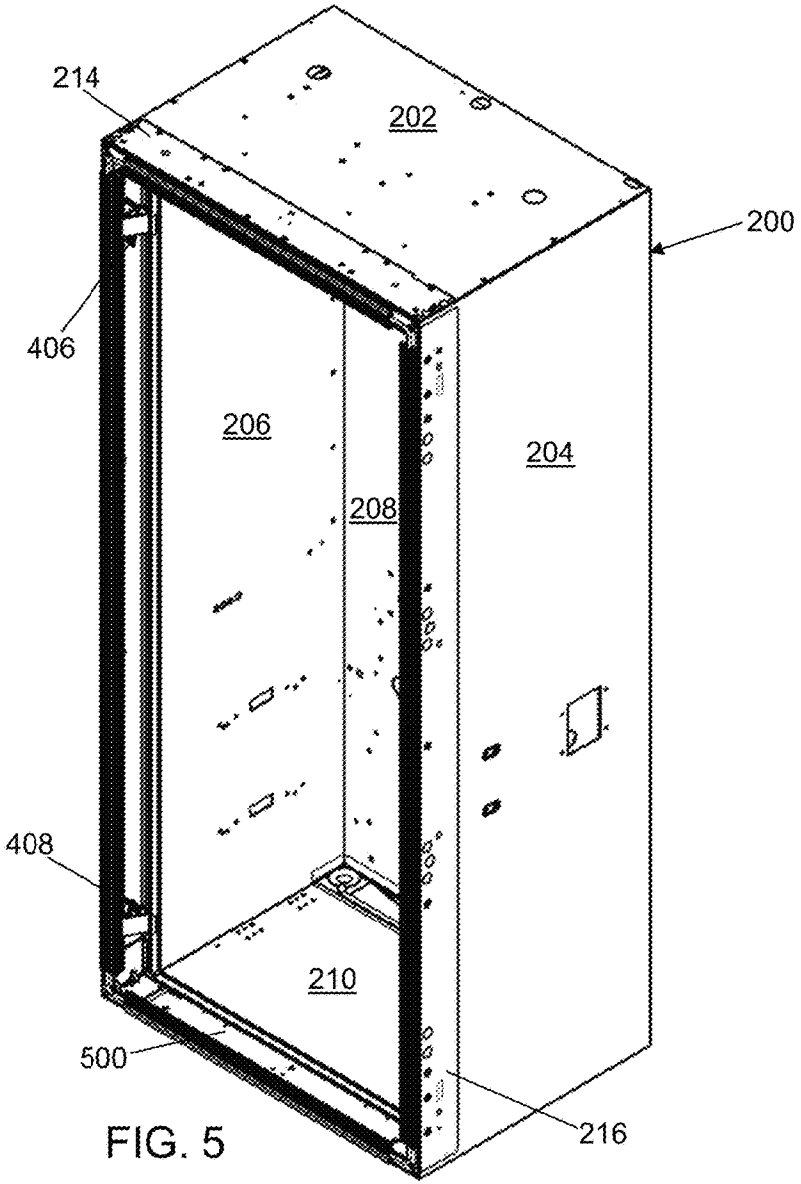
FIG. 5 depicts a right, front perspective view of the cabinet of FIG. 2 with a face frame removed in accordance with an illustrative embodiment.

Referring to FIG. 3, a right, front perspective view of a shell portion 300 of cabinet 200 is shown in accordance with an illustrative embodiment. Referring to FIG. 4, a right, front perspective view of cabinet 200 is shown with shell portion 300 removed in accordance with an illustrative embodiment. Referring to FIG. 5, a right, front perspective view of cabinet 200 is shown with a face frame 212 removed in accordance with an illustrative embodiment. Referring to FIG. 6, a left, front perspective view of cabinet 200 is shown with face frame 212 removed in accordance with an illustrative embodiment.

Cabinet 200 may include a shell exterior top wall 202, a shell exterior right wall 204, a shell exterior left wall 302, a shell exterior bottom wall 404, a shell back wall 420, a liner top wall 400, a liner right wall 402, a liner left wall 206, a liner back wall 208, a liner bottom wall 210, and face frame 212. Shell exterior top wall 202, shell exterior right wall 204, shell exterior left wall 302, shell exterior bottom wall 404, and shell back wall 420 form a first container that may be referred to as an exterior shell. Though not shown, another layer of walls may be mounted exterior of shell exterior top wall 202, shell exterior right wall 204, shell exterior left wall 302, shell exterior bottom wall 404, and/or shell back wall 420 to provide an improved appearance of cabinet 200.

Figure 8:
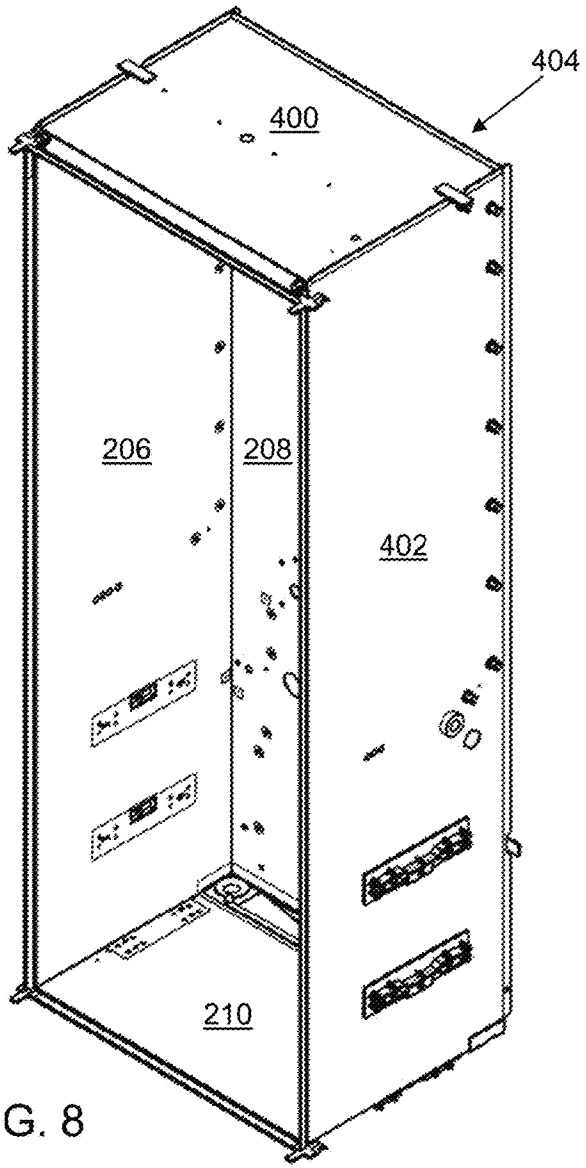
FIG. 8 depicts a right, front perspective view of a liner of the cabinet of FIG. 2 in accordance with an illustrative embodiment.

Referring to FIG. 8, a right, front perspective view of a liner 404 of cabinet 200 is shown in accordance with an illustrative embodiment. Liner 404 may include liner top wall 400, liner right wall 402, liner left wall 206, liner back wall 208, and liner bottom wall 210 that form a second container that fits within the first container, the shell exterior, separated by a cavity. Liner 404 is smaller in each direction, top, bottom, left, right, front, and back, than the shell exterior.

An insulating material such as an insulating foam may be poured or blown into the cavity between the shell exterior and liner 404 to create an insulated container. Each pair of walls, such as shell exterior right wall 204 and liner right wall 402, may form an insulated wall when the insulating material is applied between the walls. For example, in an illustrative embodiment, each pair of walls, such as shell exterior right wall 204 and liner right wall 402, may be formed of a sheet of material such as a metal or a plastic material.

A top support brace 214, a right support brace 216, a left support brace 600, and a bottom support brace 500 may be mounted to front edges of shell exterior top wall 202, shell exterior right wall 204, shell exterior left wall 302, and shell exterior bottom wall 404, respectively, to provide additional strength and rigidity to the exterior shell. In the illustrative embodiment, top support brace 214, right support brace 216, left support brace 600, and bottom support brace 500 are mounted to interior surfaces of top wall 202, shell exterior right wall 204, shell exterior left wall 302, and shell exterior bottom wall 404, respectively, though FIGS. 2, 5, 6, 9A, and 9B show them on an exterior surface to show a relative position of top support brace 214, right support brace 216, left support brace 600, and bottom support brace 500.

A top retainer tube 410, a right retainer tube 412, a bottom retainer tube 414, and a left retainer tube 416 may be mounted to top support brace 214, right support brace 216, bottom support brace 500, and left support brace 600, respectively, and/or to shell exterior top wall 202, shell exterior right wall 204, shell exterior left wall 302, and shell exterior bottom wall 404. A tube 418 may be mounted to top retainer tube 410, right retainer tube 412, bottom retainer tube 414, and/or left retainer tube 416. Face frame 212 may be mounted to cover top retainer tube 410, right retainer tube 412, bottom retainer tube 414, and left retainer tube 416.

A first liner hanger 406 and a second liner hanger 408 may be mounted between liner left wall 206 and shell exterior left wall 302 and/or left support brace 600 to span the cavity there between to maintain a consistent separation distance between liner left wall 206 and shell exterior left wall 302. In an alternative embodiment, one or more additional liner hangers may be mounted between liner left wall 206 and shell exterior left wall 302 and/or left support brace 600. In an alternative embodiment, a single liner hanger may be mounted between liner left wall 206 and shell exterior left wall 302 and/or left support brace 600. A number of liner hangers mounted between liner left wall 206 and shell exterior left wall 302 and/or left support brace 600 may be selected, for example, based on a length of liner left wall 206 and shell exterior left wall 302 and/or a width of the cavity between liner left wall 206 and shell exterior left wall 302.

First liner hanger 406 is mounted in a top, left portion of cabinet 200. Second liner hanger 408 is mounted in a bottom, left portion of cabinet 200. The location of first liner hanger 406 and second liner hanger 408 may be selected to provide a sufficiently consistent separation distance between liner left wall 206 and shell exterior left wall 302.

A third liner hanger 602 and a fourth liner hanger 604 may be mounted between liner right wall 402 and shell exterior right wall 204 and/or right support brace 216 to span the cavity there between to maintain a consistent separation distance between liner left wall 206 and shell exterior left wall 302. In an alternative embodiment, one or more additional liner hangers may be mounted between liner right wall 402 and shell exterior right wall 204 and/or right support brace 216. In an alternative embodiment, a single liner hanger may be mounted between liner right wall 402 and shell exterior right wall 204 and/or right support brace 216. A number of liner hangers mounted between liner right wall 402 and shell exterior right wall 204 and/or right support brace 216 may be selected, for example, based on a length of liner right wall 402 and shell exterior right wall 204 and/or a width of the cavity between liner right wall 402 and shell exterior right wall 204.

Third liner hanger 602 is mounted in a top, right portion of cabinet 200. Fourth liner hanger 604 is mounted in a bottom, right portion of cabinet 200. The location of third liner hanger 602 and fourth liner hanger 604 may be selected to provide a sufficiently consistent separation distance between liner right wall 402 and shell exterior right wall 204.

First liner hanger 406, second liner hanger 406, third liner hanger 602, and fourth liner hanger 604 have a common shape and size though this is not required. In an alternative embodiment, one or more liner hangers may be mounted to span the cavity between liner top wall 400 and shell exterior top wall 202. In an alternative embodiment, one or more liner hanger may be mounted to span the cavity between liner bottom wall 210 and shell exterior bottom wall 404.

Figure 7:
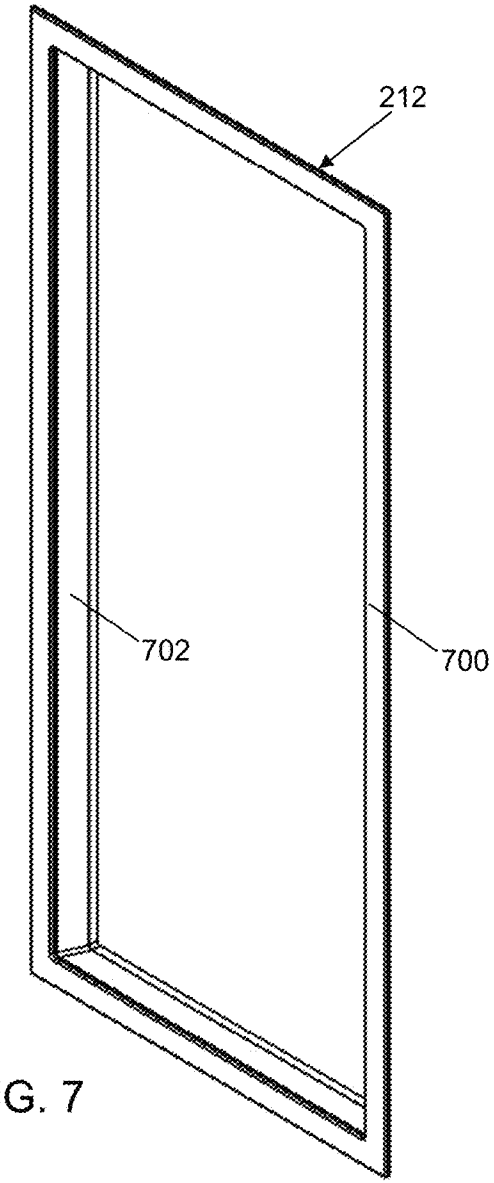
FIG. 7 depicts a left, front perspective view of the face frame of the cabinet of FIG. 2 in accordance with an illustrative embodiment.

Referring to FIG. 7, a left, front perspective view of face frame 212 is shown in accordance with an illustrative embodiment. In the illustrative embodiment, face frame 212 includes face wall 700 and frame sidewall 702. Face wall 700 has a size and shape selected to fit over the cavity and span the gap between an exterior edge of liner 404 and an exterior edge of the shell exterior. In the illustrative embodiment, face wall 700 has a rectangular shape defined by a shape of cabinet 200. Frame sidewall 702 extends generally perpendicularly from an interior edge of face wall 700 to further fit over the cavity and span the gap between the exterior edge of liner 404 and the exterior edge of the shell exterior.

Figure 9A:
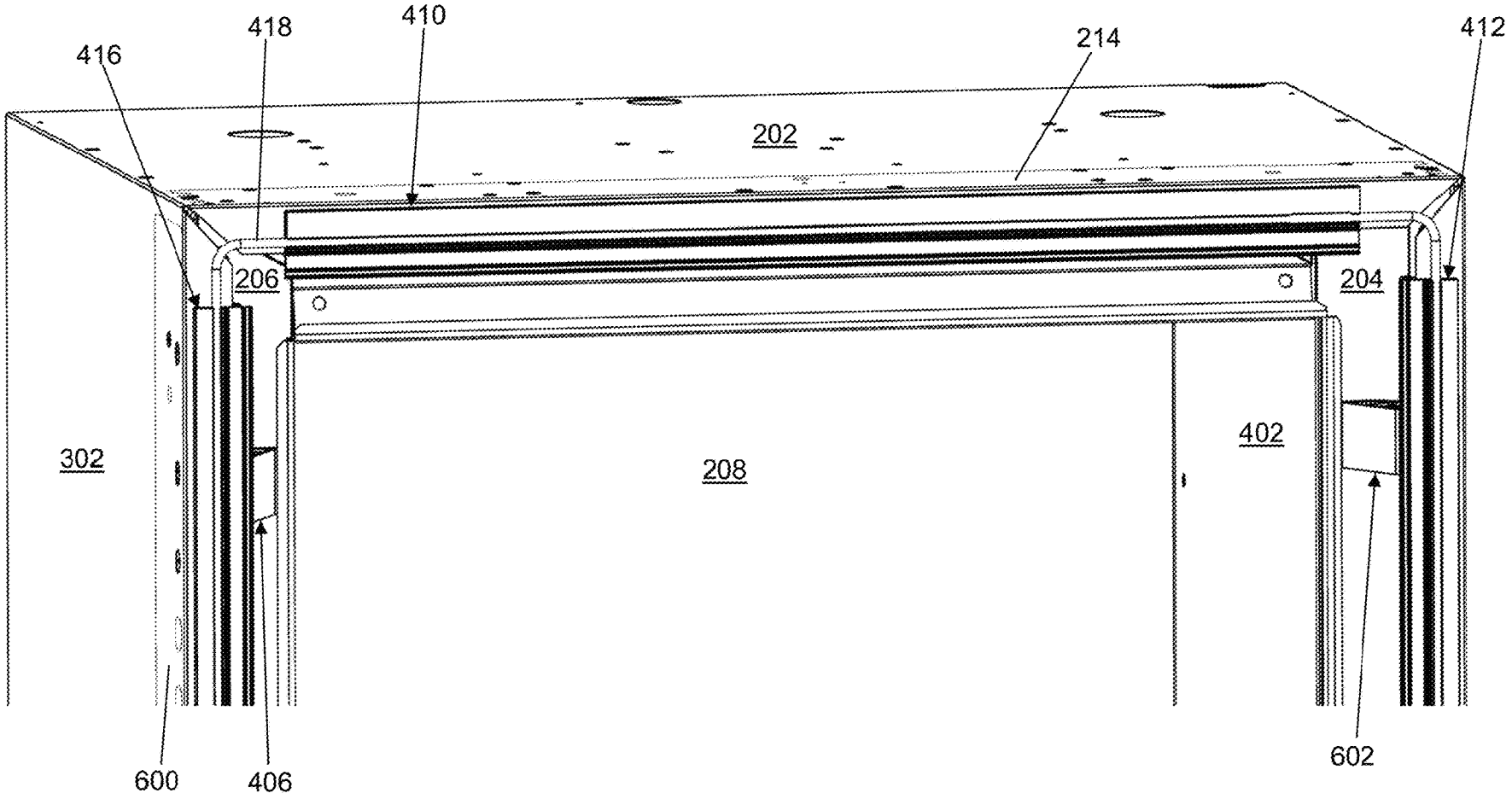
FIG. 9A depicts a left, front perspective view of a top portion of the cabinet of FIG. 5 in accordance with an illustrative embodiment.
Figure 9B:
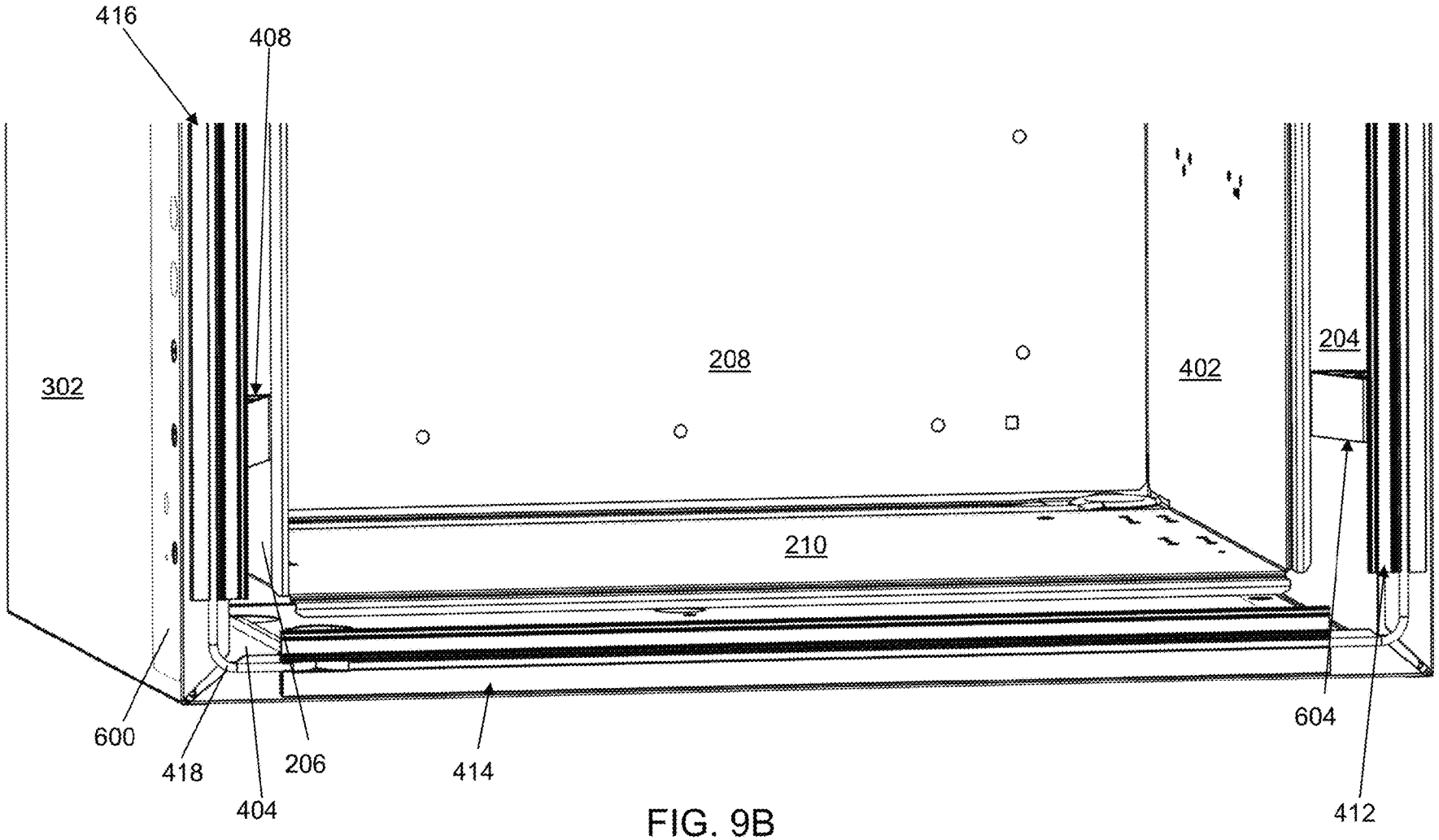
FIG. 9B depicts a left, front perspective view of a bottom portion of the cabinet of FIG. 5 in accordance with an illustrative embodiment.
Figure 10:
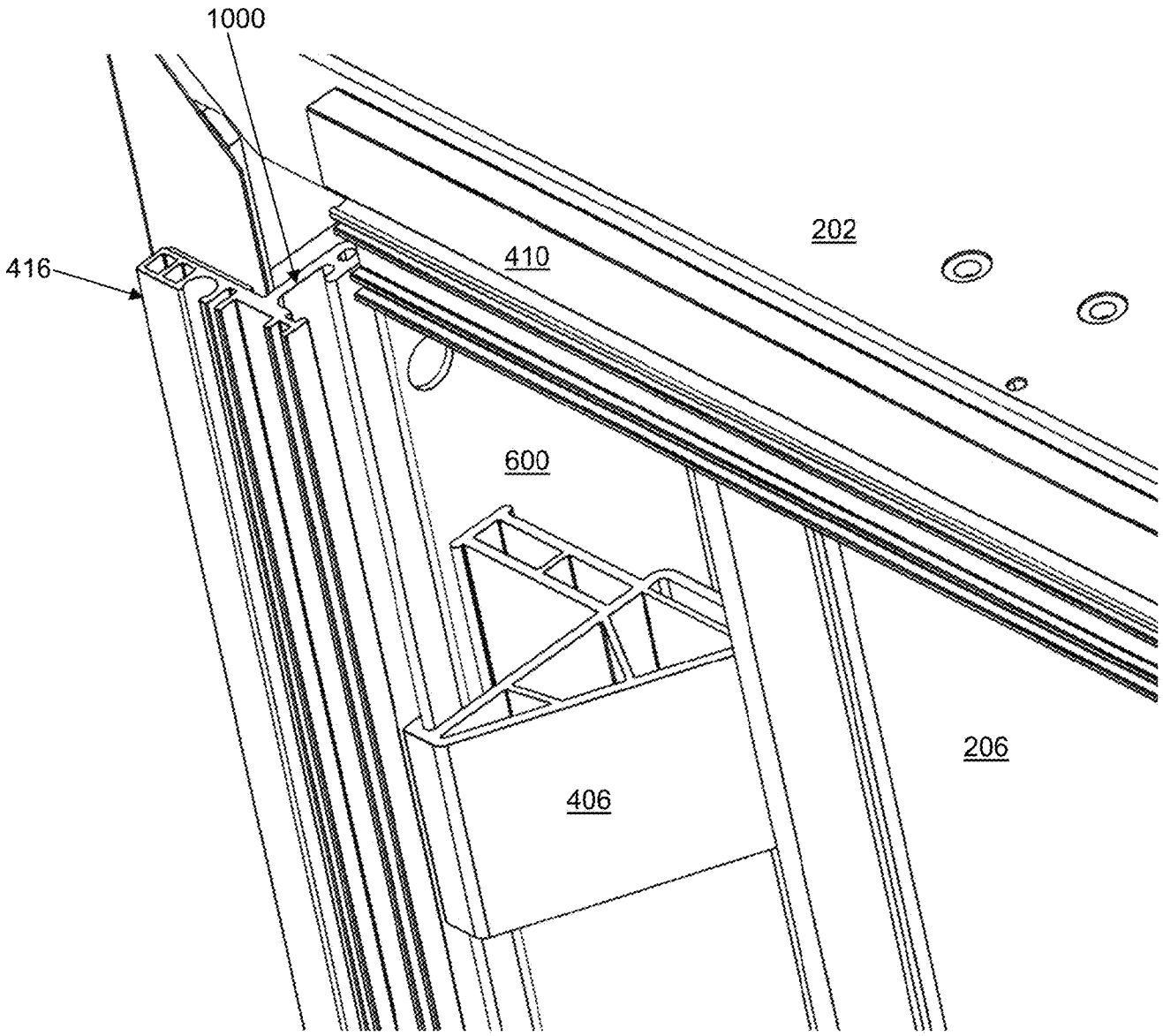
FIG. 10 depicts a right, front perspective view of a top, left portion of the cabinet of FIG. 5 in accordance with an illustrative embodiment.

Referring to FIG. 9A, a left, front perspective view of a top portion of cabinet 200 is shown with face frame 212 removed in accordance with an illustrative embodiment. Referring to FIG. 9B, a left, front perspective view of a bottom portion of cabinet 200 is shown with face frame 212 removed in accordance with an illustrative embodiment. Referring to FIG. 10, a right, front perspective view of a top, left portion of cabinet 200 is shown with face frame 212 removed in accordance with an illustrative embodiment. First liner hanger 406 and second liner hanger 408 mount to a retainer hook portion 1000 of left retainer tube 416.

Figure 11A:
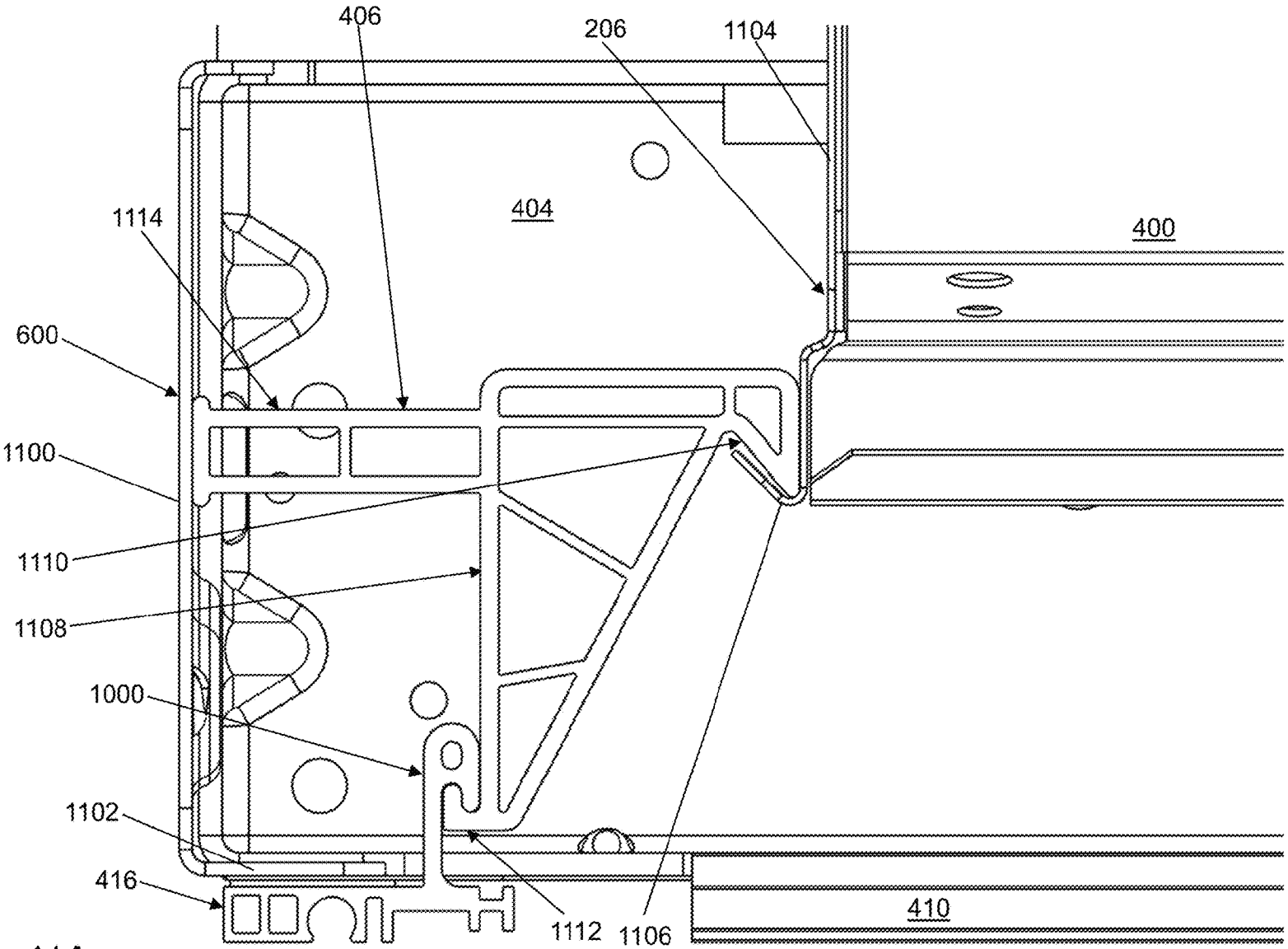
FIG. 11A depicts a top view of the top, left portion of the cabinet of FIG. 5 with a shell exterior left wall, a shell exterior top wall, and a top support brace removed in accordance with an illustrative embodiment.
Figure 11B:
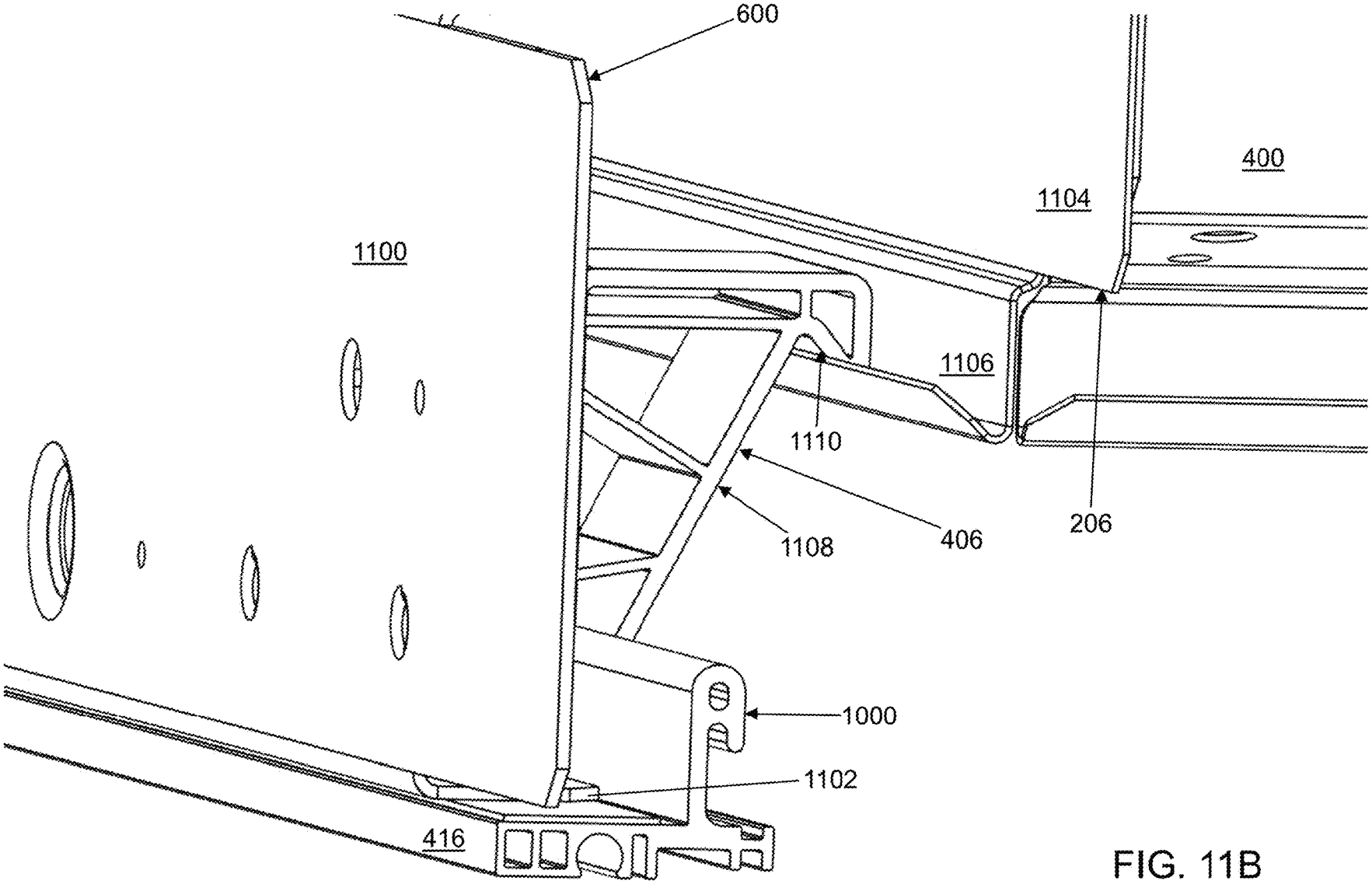
FIG. 11B depicts a top, left view of the top, left portion of FIG. 11A in accordance with an illustrative embodiment.
Figure 11C:
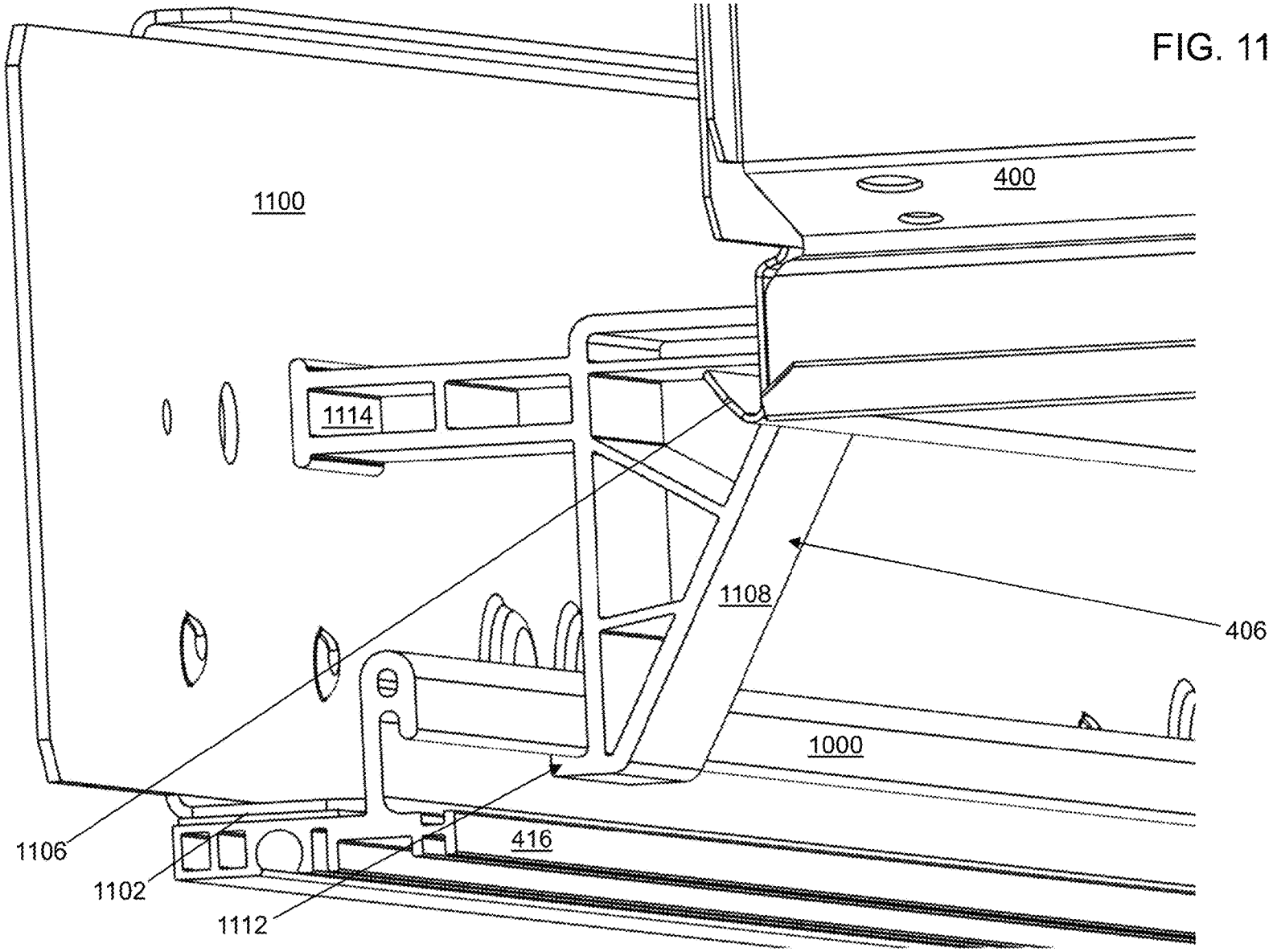
FIG. 11C depicts a top, right view of the top, left portion of FIG. 11A in accordance with an illustrative embodiment.
Figure 11D:
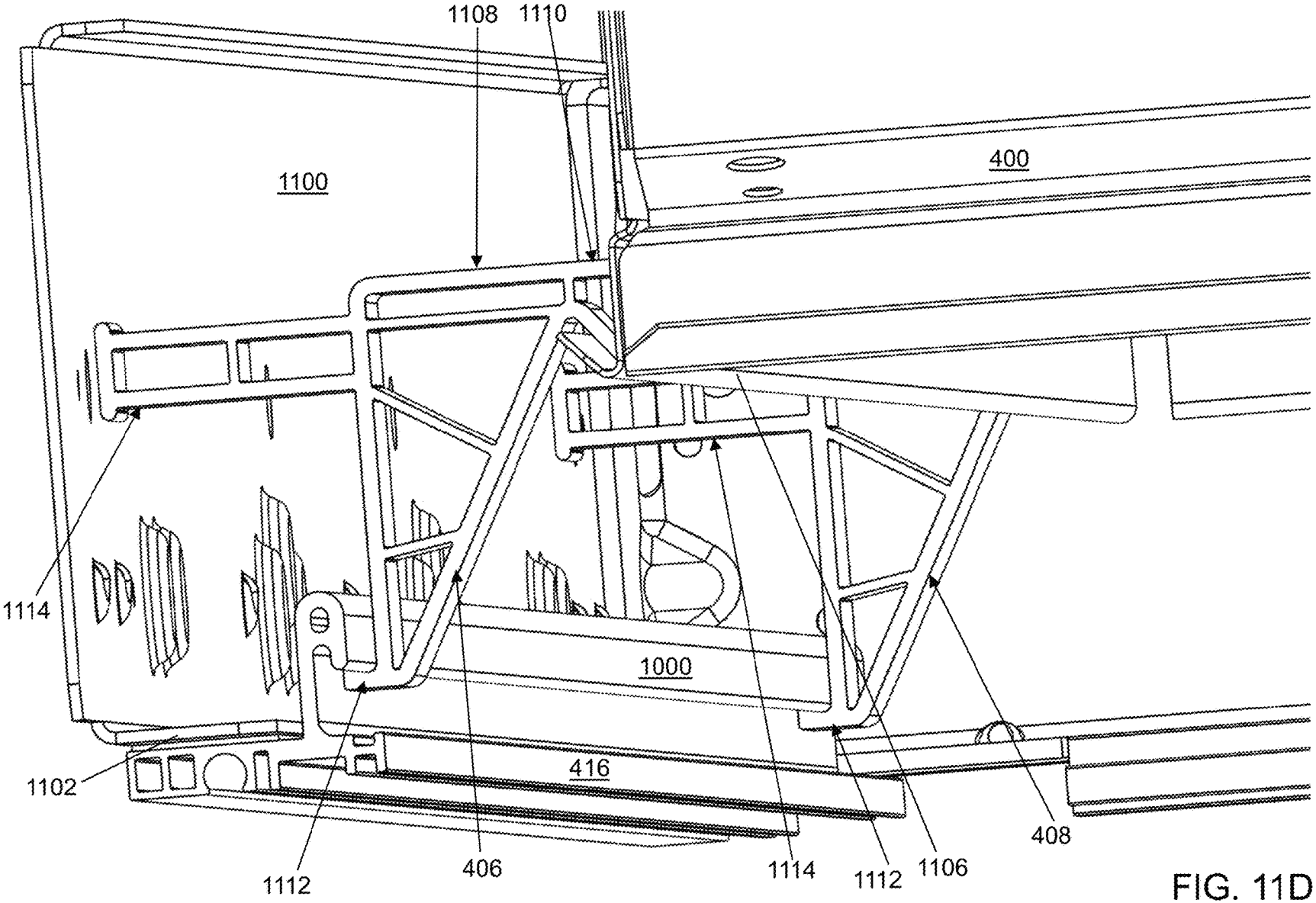
FIG. 11D depicts a second top, right view of the top, left portion of FIG. 11A in accordance with an illustrative embodiment.
Figure 11E:
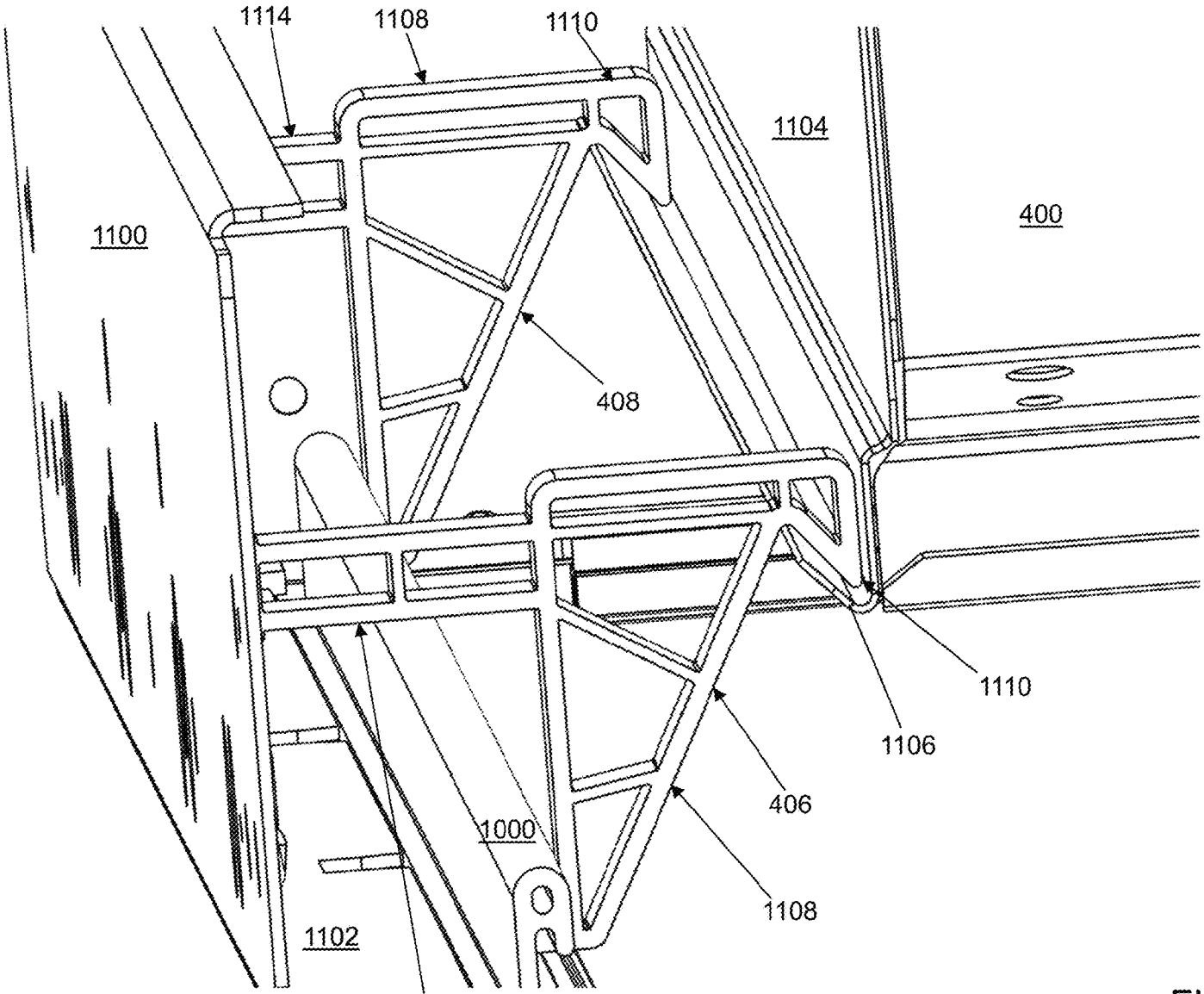
FIG. 11E depicts a second top, left view of the top, left portion of FIG. 11A in accordance with an illustrative embodiment.

Referring to FIG. 11A, a top view of the top, left portion of cabinet 200 is shown with face frame 212, shell exterior left wall 302, shell exterior top wall 202, and top support brace 214 removed in accordance with an illustrative embodiment. Referring to FIG. 11B, a top, left view of the top, left portion of FIG. 11A is shown in accordance with an illustrative embodiment. Referring to FIG. 11C, a top, right view of the top, left portion of FIG. 11A is shown in accordance with an illustrative embodiment. Referring to FIG. 11D, a second top, right view of the top, left portion of FIG. 11A is shown in accordance with an illustrative embodiment. Referring to FIG. 11E, a second top, left view of the top, left portion of FIG. 11A is shown in accordance with an illustrative embodiment.

Left support brace 600 may include a support brace sidewall 1100 and a support brace flange 1102. Though not shown, top support brace 214, right support brace 216, and bottom support brace 500 have a similar size and shape to left support brace 600 though top support brace 214 and bottom support brace 500 are shorter due to the rectangular shape of cabinet 200. Support brace flange 1102 extends generally perpendicularly from an edge of support brace sidewall 1100. Support brace sidewall 1100 may be mounted to an interior face of shell exterior left wall 302 and be parallel to the interior face of shell exterior left wall 302.

Liner left wall 206 may include a left liner sidewall 1104 that is generally flat and a left wall liner abutment wall 1106 that extends from an exterior edge of left liner sidewall 1104. Left wall liner abutment wall 1106 forms a surface for mounting to first liner hanger 406 and second liner hanger 408. In the illustrative embodiment, left wall liner abutment wall 1106 forms a v-shaped valley though left wall liner abutment wall 1106 may form a ∪-shaped valley, an Γ-shaped valley, etc. on which liner left wall 206 is mounted to first liner hanger 406 and second liner hanger 408.

First liner hanger 406 may include a hanger body 1108, a hanger liner mating portion 1110, a hanger retainer mating portion 1112, and a hanger brace portion 1114. When mounted to cabinet 200, hanger liner mating portion 1110 mounts to left wall liner abutment wall 1106, hanger retainer mating portion 1112 mount to retainer hook portion 1000 of left retainer tube 416, and hanger brace portion 1114 abuts an interior surface of support brace sidewall 1100 of left support brace 600. In an alternative embodiment, hanger brace portion 1114 abuts the interior face of shell exterior left wall 302. Second liner hanger 408 similarly mounts to cabinet 200.

Figure 11F:
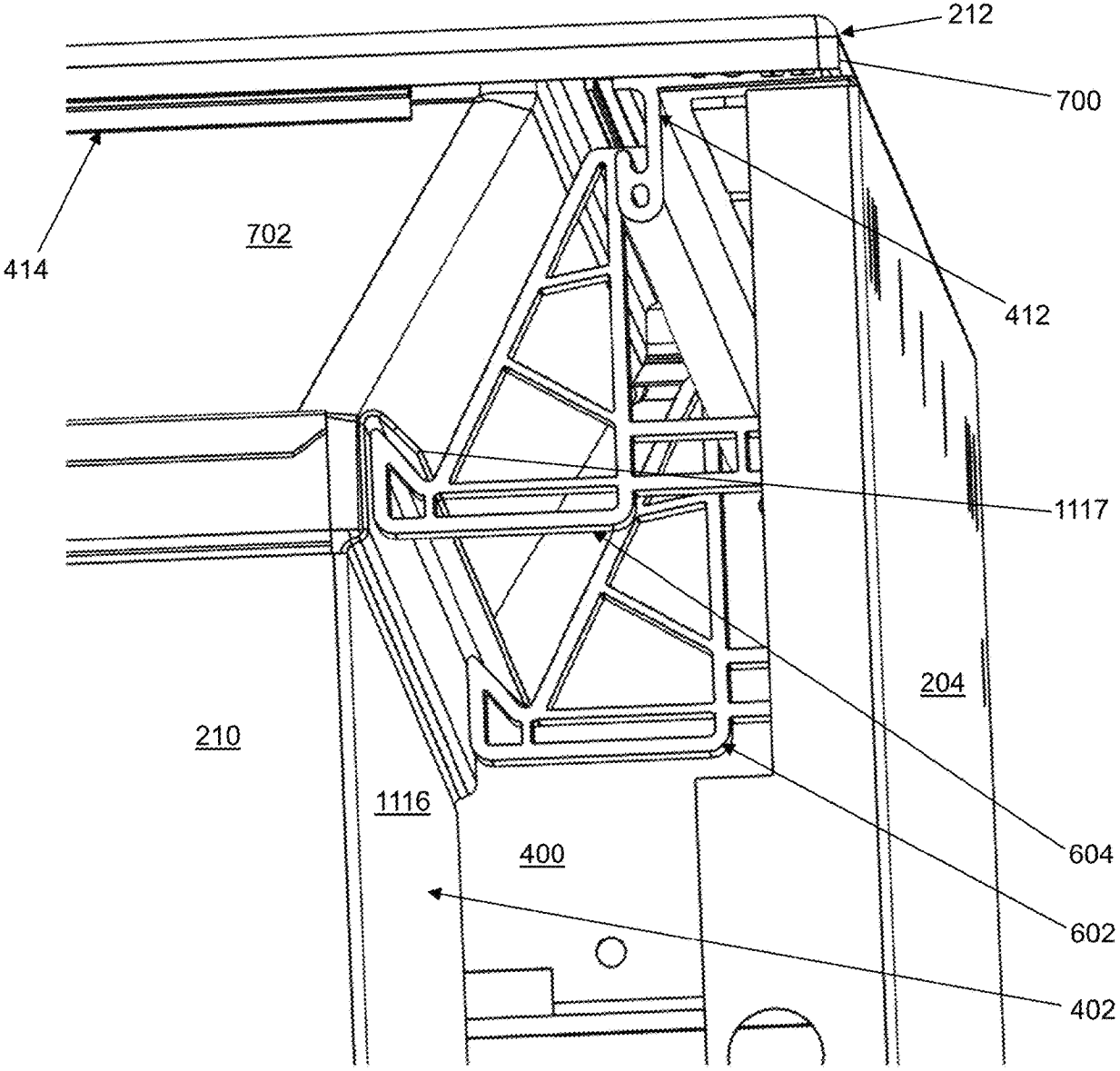
FIG. 11F depicts a bottom, right view of a bottom, right portion of the cabinet of FIG. 2 with a shell exterior bottom wall removed in accordance with an illustrative embodiment.
Figure 11G:
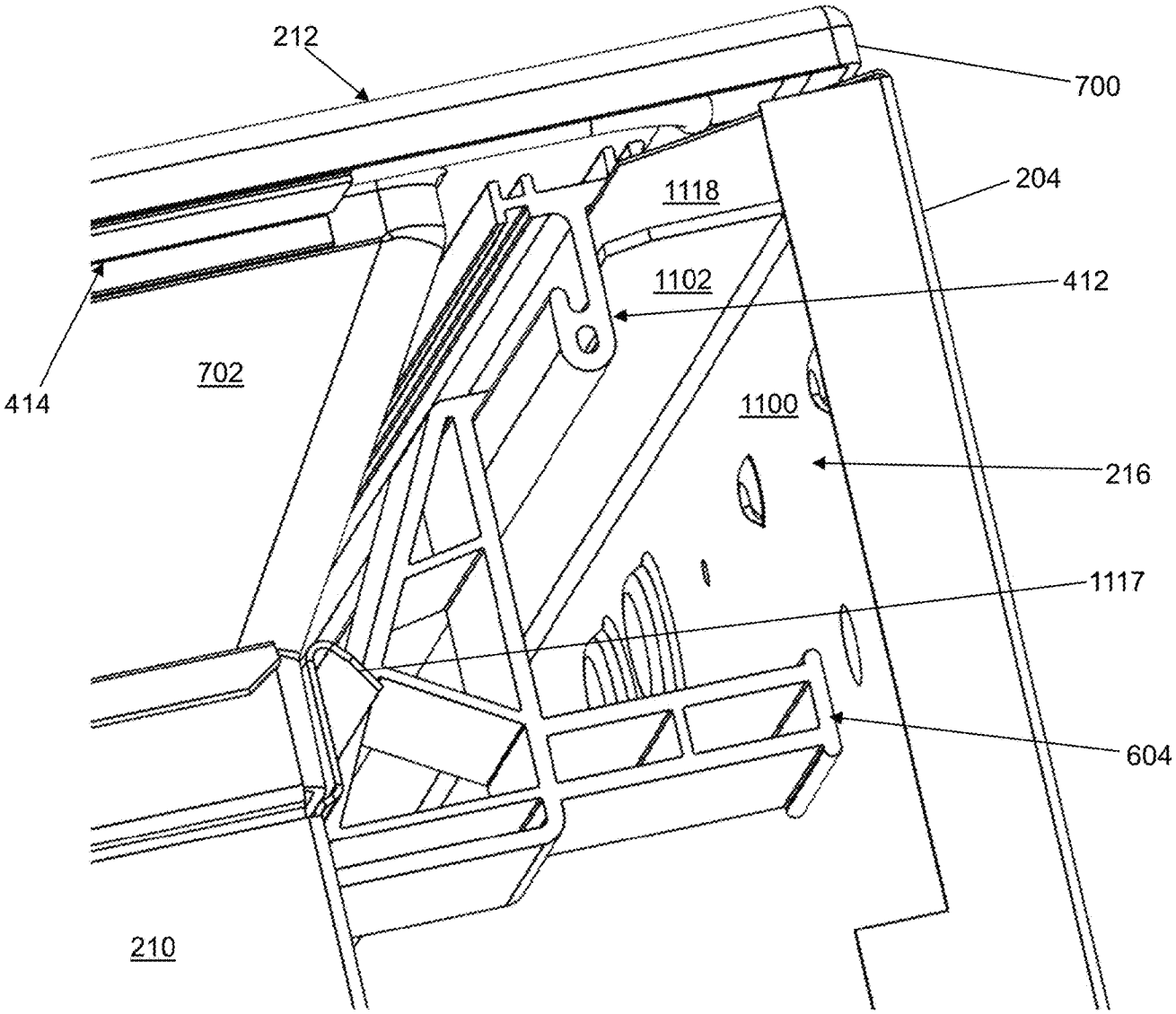
FIG. 11G depicts a bottom, left view of the bottom, right portion of the cabinet of FIG. 2 with the shell exterior bottom wall removed in accordance with an illustrative embodiment.
Figure 11H:
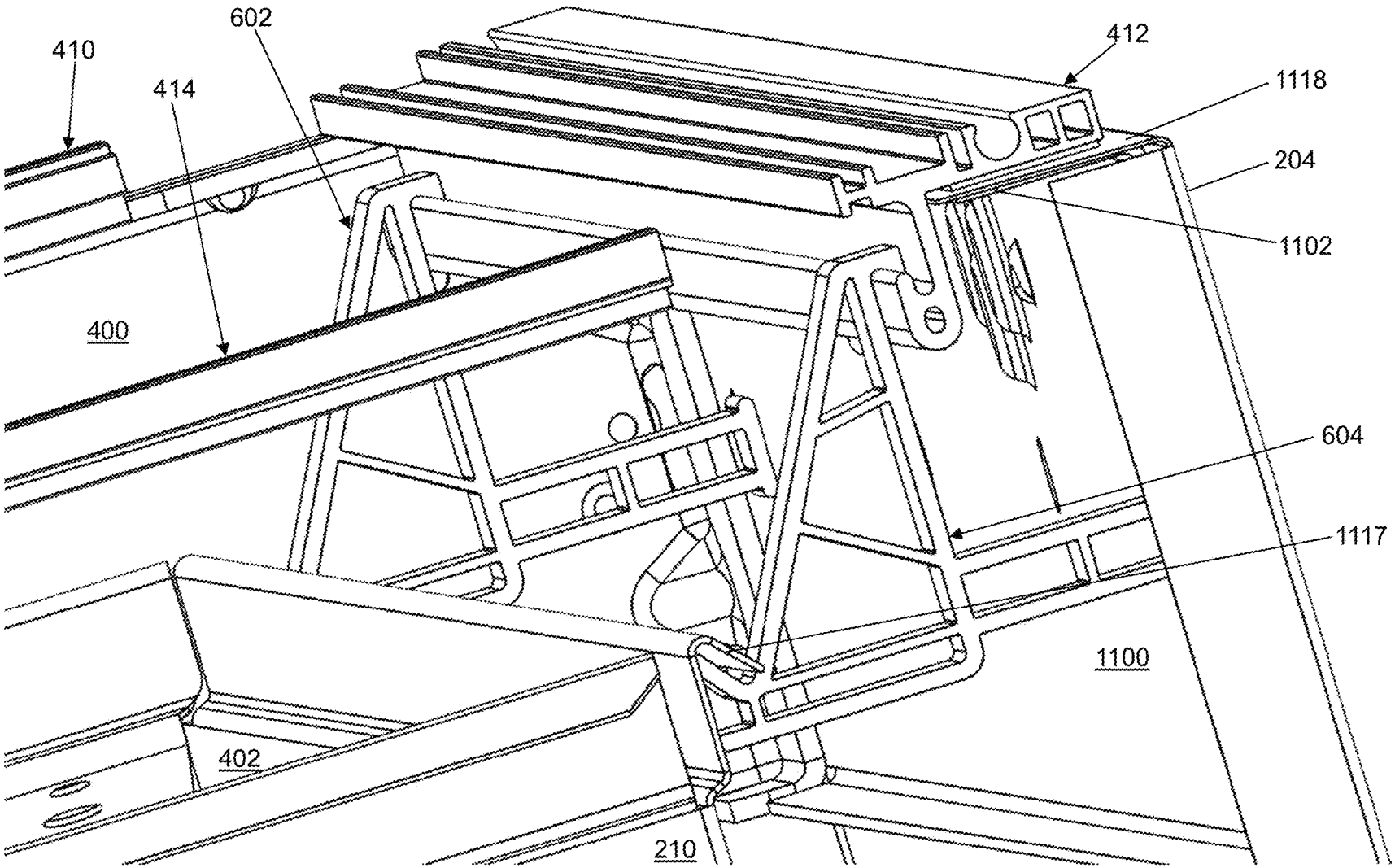
FIG. 11H depicts a bottom, left view of the bottom, right portion of the cabinet of FIG. 2 with the shell exterior bottom wall and the face frame removed in accordance with an illustrative embodiment.

Referring to FIG. 11F, a bottom, right view is shown of a bottom, right portion of cabinet 200 with shell exterior bottom wall 404 removed in accordance with an illustrative embodiment. Referring to FIG. 11G, a bottom, left view is shown of the bottom, right portion of cabinet 200 with shell exterior bottom wall 404 removed in accordance with an illustrative embodiment. Referring to FIG. 11H, a bottom, left view is shown of the bottom, right portion of cabinet 200 with shell exterior bottom wall 404 and face frame 212 removed in accordance with an illustrative embodiment.

Similar to liner left wall 206, liner right wall 402 may include a right liner sidewall 1116 that is generally flat and a right wall liner abutment wall 1117 that extends from an exterior edge of right liner sidewall 1116. Right wall liner abutment wall 1117 forms a surface for mounting to third liner hanger 602 and fourth liner hanger 604. In the illustrative embodiment, right wall liner abutment wall 1117 forms a v-shaped valley though right wall liner abutment wall 1117 may form a ∪-shaped valley, an Γ-shaped valley, etc. on which liner right wall 402 is mounted to third liner hanger 602 and fourth liner hanger 604.

Similar to left support brace 600, right support brace 216 may include support brace sidewall 1100 and support brace flange 1102 where support brace sidewall 1100 may be mounted to an interior face of shell exterior right wall 204 and be parallel to the interior face of shell exterior right wall 204. A sidewall flange 1118 extends generally perpendicularly from a right edge of shell exterior right wall 204 towards an interior of cabinet 200. Sidewall flange 1118 is positioned between support brace flange 1102 of right support brace 216 and right retainer tube 412. As a result, right retainer tube 412 mounts to sidewall flange 1118 in the illustrative embodiment. Though not shown, sidewall flange 1118 is further positioned between support brace flange 1102 of left support brace 600 and left retainer tube 416. As a result, left retainer tube 416 also mounts to sidewall flange 1118 in the illustrative embodiment. Third liner hanger 602 and fourth liner hanger 604 mount to cabinet 200 in a manner similar to that described for first liner hanger 406 though between liner right wall 402, right support brace 216, and right retainer tube 412.

In the illustrative embodiment, top retainer tube 410 and bottom retainer tube 414 do not include retainer hook portion 1000 because no liner hanger is mounted to top retainer tube 410 and bottom retainer tube 414. In an alternative embodiment, top retainer tube 410 and bottom retainer tube 414 may include retainer hook portion 1000 to support one or more liner hanger.

Figure 12:
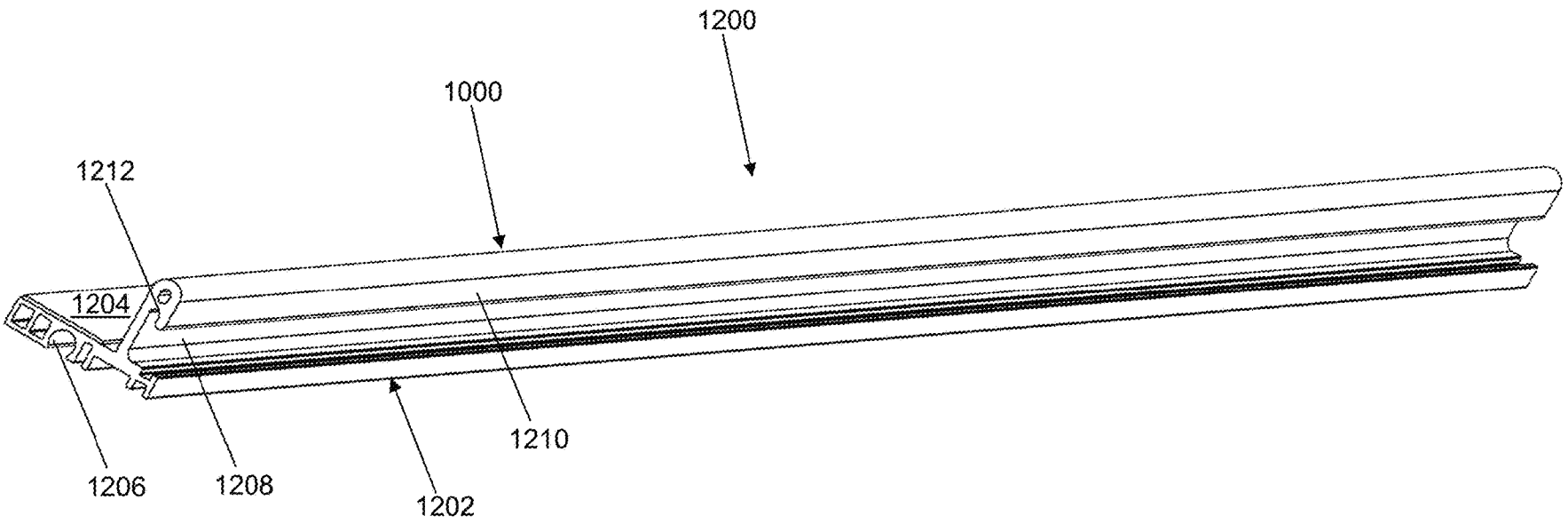
FIG. 12 depicts a perspective view of a retainer tube of the cabinet of FIG. 2 in accordance with an illustrative embodiment.

Referring to FIG. 12, a perspective view of a retainer tube 1200 of cabinet 200 is shown in accordance with an illustrative embodiment. Any or all of top retainer tube 410, right retainer tube 412, bottom retainer tube 414, left retainer tube 416 are examples of retainer tube 1200 that may have various widths and lengths based on a size of a respective compartment. Retainer tube 1200 may include a tube body 1202, and retainer hook portion 1000. Tube body 1202 may include a tube mounting face 1204 and a tube channel 1206. Tube mounting face 1204 is on a first face of tube body 1202 on a first side of retainer hook portion 1000. Tube channel 1206 forms a c-shaped channel on a second face of tube body 1202 that is opposite the first face of tube body 1202. Tube 418 may be mounted and retained within tube channel 1206.

Retainer hook portion 1000 may include a hook extension wall 1208 and a hook wall 1210. Hook wall 1210 curves away from an end of hook extension wall 1208 opposite an end of hook extension wall 1208 that extends from the first face of tube body 1202 to form a hook channel 1212. In the illustrative embodiment, hook channel 1212 forms a ∪-shaped valley, though hook channel 1212 may form a v-shaped valley, an Γ-shaped valley, etc. to provide a surface that supports first liner hanger 406, second liner hanger 408, third liner hanger 602, and/or fourth liner hanger 604.

Retainer tube 1200 may be formed of a single continuous piece of material, for example, by molding, or may be formed of multiple distinct pieces mounted together or attached to each other, for example, using various fasteners including adhesive, a screw, a rivet, etc. Tube mounting face 1204 of retainer tube 1200 may be mounted to an exterior surface of sidewall flange 1118 of shell top wall 202, shell exterior right wall 204, shell exterior left wall 302, or shell exterior bottom wall 404, for example, using adhesive, a screw, a rivet, etc.

Figure 13A:
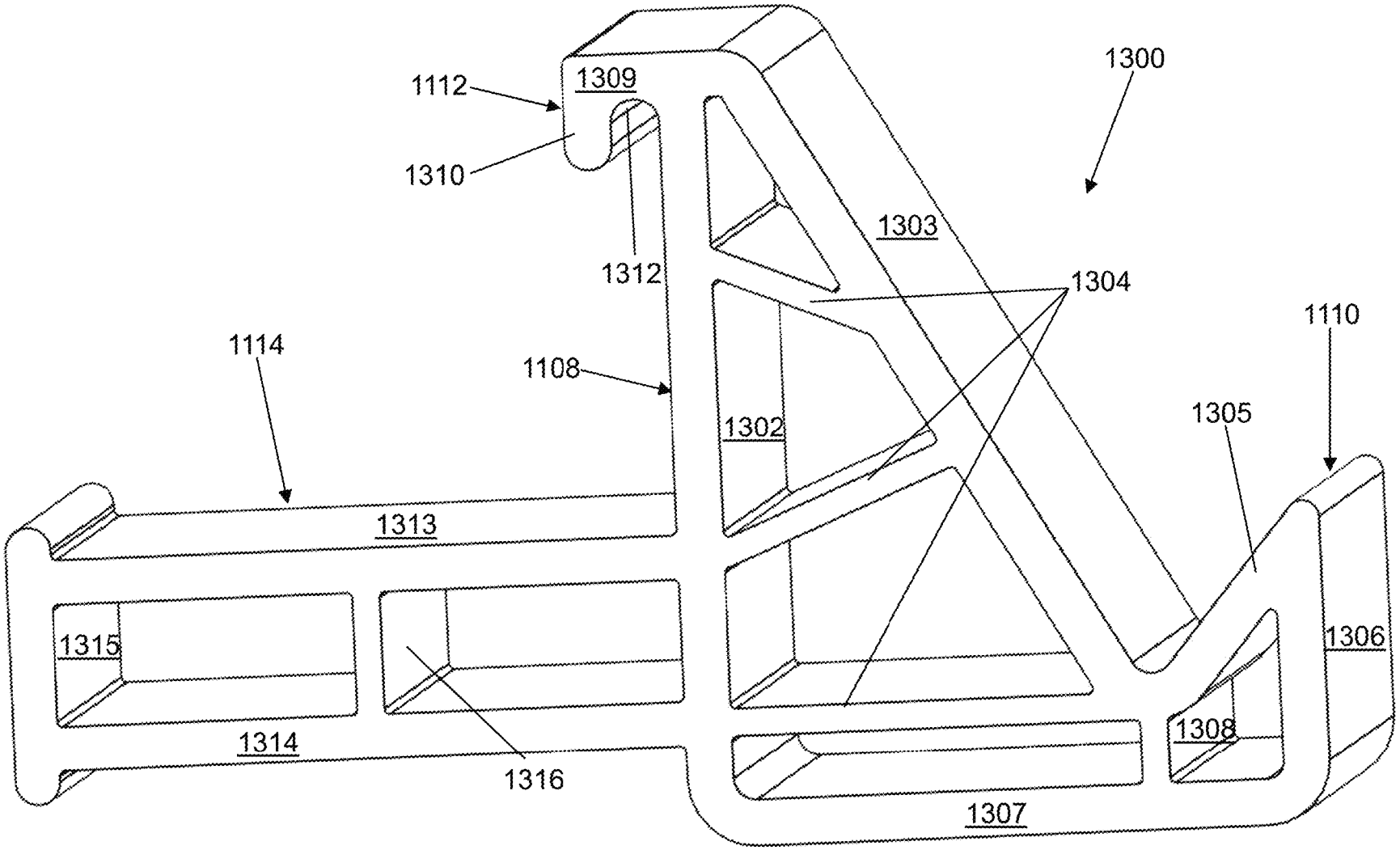
FIG. 13A depicts a perspective view of a first liner hanger of the cabinet of FIG. 2 in accordance with an illustrative embodiment.

Referring to FIG. 13A, a perspective view of a first hanger 1300 of cabinet 200 is shown in accordance with an illustrative embodiment. First hanger 1300 may be used as first liner hanger 406, second liner hanger 408, third liner hanger 602, and/or fourth liner hanger 604. As described above, first hanger 1300 may include hanger body 1108, hanger liner mating portion 1110, hanger retainer mating portion 1112, and hanger brace portion 1114.

In the illustrative embodiment of FIG. 13A, hanger body 1108 may include a main body wall 1302, a second body wall 1303, and a plurality of ribs 1304 that extend between main body wall 1302 and second body wall 1303 to provide a frame to which hanger liner mating portion 1110, hanger retainer mating portion 1112, and hanger brace portion 1114 are mounted. Second body wall 1303 and the plurality of ribs 1304 extend from a first face of main body wall 1302. Second body wall 1303 and the plurality of ribs 1304 add strength and rigidity to hanger body 1108 of first hanger 1300.

In the illustrative embodiment of FIG. 13A, hanger liner mating portion 1110 may include a first liner abutment wall 1305, a support wall 1306, an extension wall 1307, and a rib 1308. First liner abutment wall 1305 forms a surface that abuts, for example, left wall liner abutment wall 1106 or right wall liner abutment wall 1117 when first hanger 1300 is mounted to cabinet 200. First liner abutment wall 1305 has a complimentary shape to left wall liner abutment wall 1106 and/or right wall liner abutment wall 1117. In the illustrative embodiment, first liner abutment wall 1305 and a lower portion of second body wall 1303 form a v-shaped valley though first liner abutment wall 1305 may form a ∪-shaped valley, an Γ-shaped valley, etc.

Support wall 1306 extends between an edge of first liner abutment wall 1305 and extension wall 1307. Extension wall 1307 extends between an edge of main body wall 1302 and an edge of support wall 1306. Rib 1308 is formed below the channel formed by first liner abutment wall 1305 and the lower portion of second body wall 1303. Rib 1308 is formed between the channel and extension wall 1307 to add strength and rigidity to hanger liner mating portion 1110 of first hanger 1300.

In the illustrative embodiment of FIG. 13A, hanger retainer mating portion 1112 may include a hook extension wall 1309 and a hook wall 1310. Hook extension wall 1309 extends between hook wall 1310 and a second face of main body wall 1302 that is on an opposite side relative to the first face of main body wall 1302. Hook wall 1310 curves away from an end of hook extension wall 1309 to form a hook channel 1312. Hook channel 1312 has a complimentary shape to hook channel 1212 of retainer tube 1200. In the illustrative embodiment, hook channel 1312 forms a ∪-shaped valley, though channel 1312 may form a v-shaped valley, an Γ-shaped valley, etc.

In the illustrative embodiment of FIG. 13A, hanger brace portion 1114 may include a first brace wall 1313, a second brace wall 1314, an abutment wall 1315, and a rib 1316. First brace wall 1313 and second brace wall 1314 are parallel and extend from the second face of main body wall 1302. Abutment wall 1315 is mounted between edges of first brace wall 1313 and second brace wall 1314 opposite the second face of main body wall 1302. Rib 1316 is formed between first brace wall 1313 and second brace wall 1314 to add strength and rigidity to hanger brace portion 1114 of first hanger 1300. Inclusion of two brace walls further adds strength and rigidity to hanger brace portion 1114 of first hanger 1300.

Figure 13B:
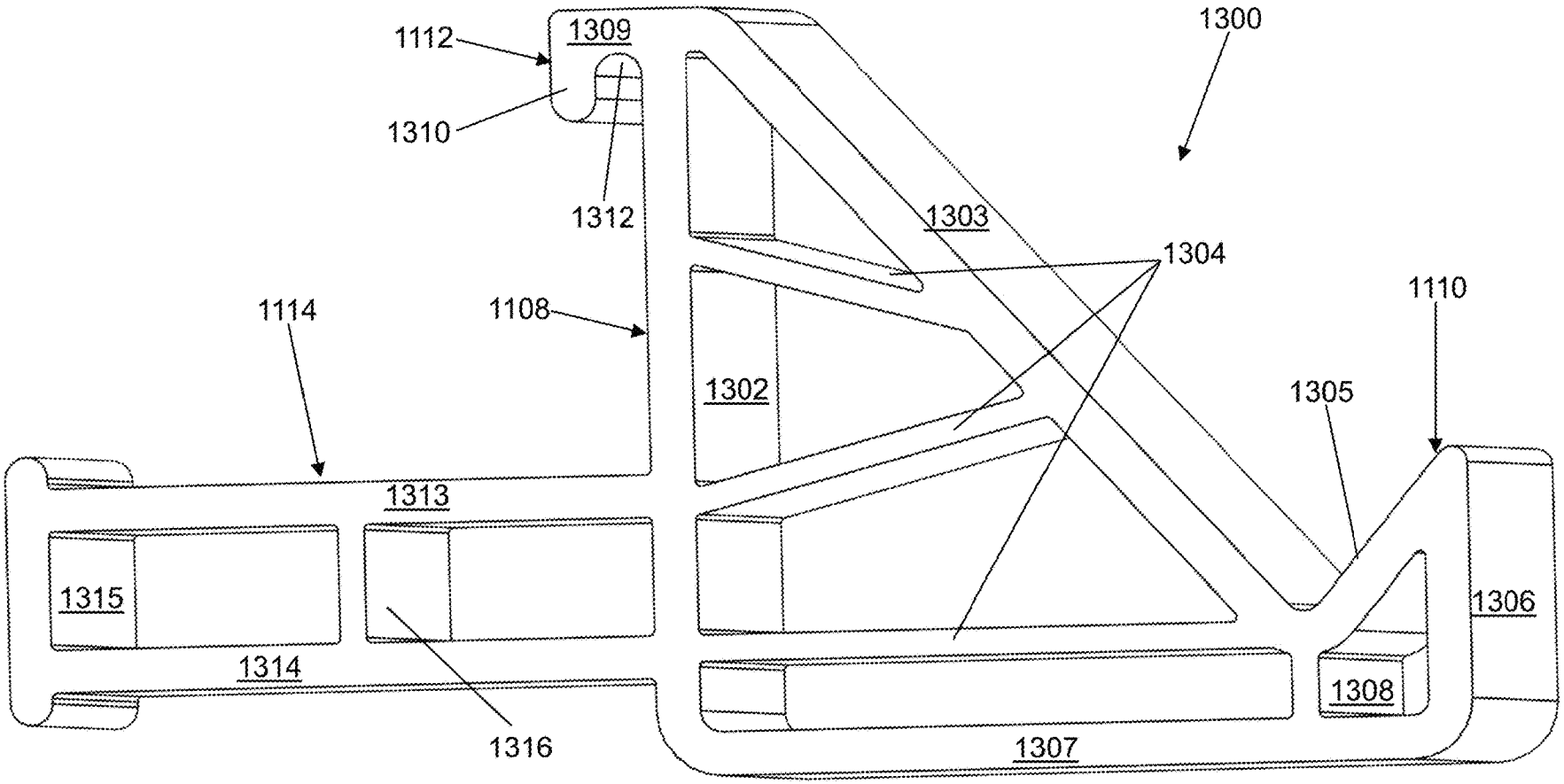
FIG. 13B depicts a perspective view of a second liner hanger of the cabinet of FIG. 2 in accordance with an illustrative embodiment.

Referring to FIG. 13B, a perspective view of a second hanger 1320 of cabinet 200 is shown in accordance with an illustrative embodiment. Second hanger 1300 may be used as first liner hanger 406, second liner hanger 408, third liner hanger 602, and/or fourth liner hanger 604. As described above, second hanger 1320 may include hanger body 1108, hanger liner mating portion 1110, hanger retainer mating portion 1112, and hanger brace portion 1114. Second hanger 1320 has a similar shape to first liner 1300 with an elongated hanger body 1108.

Figure 13C:
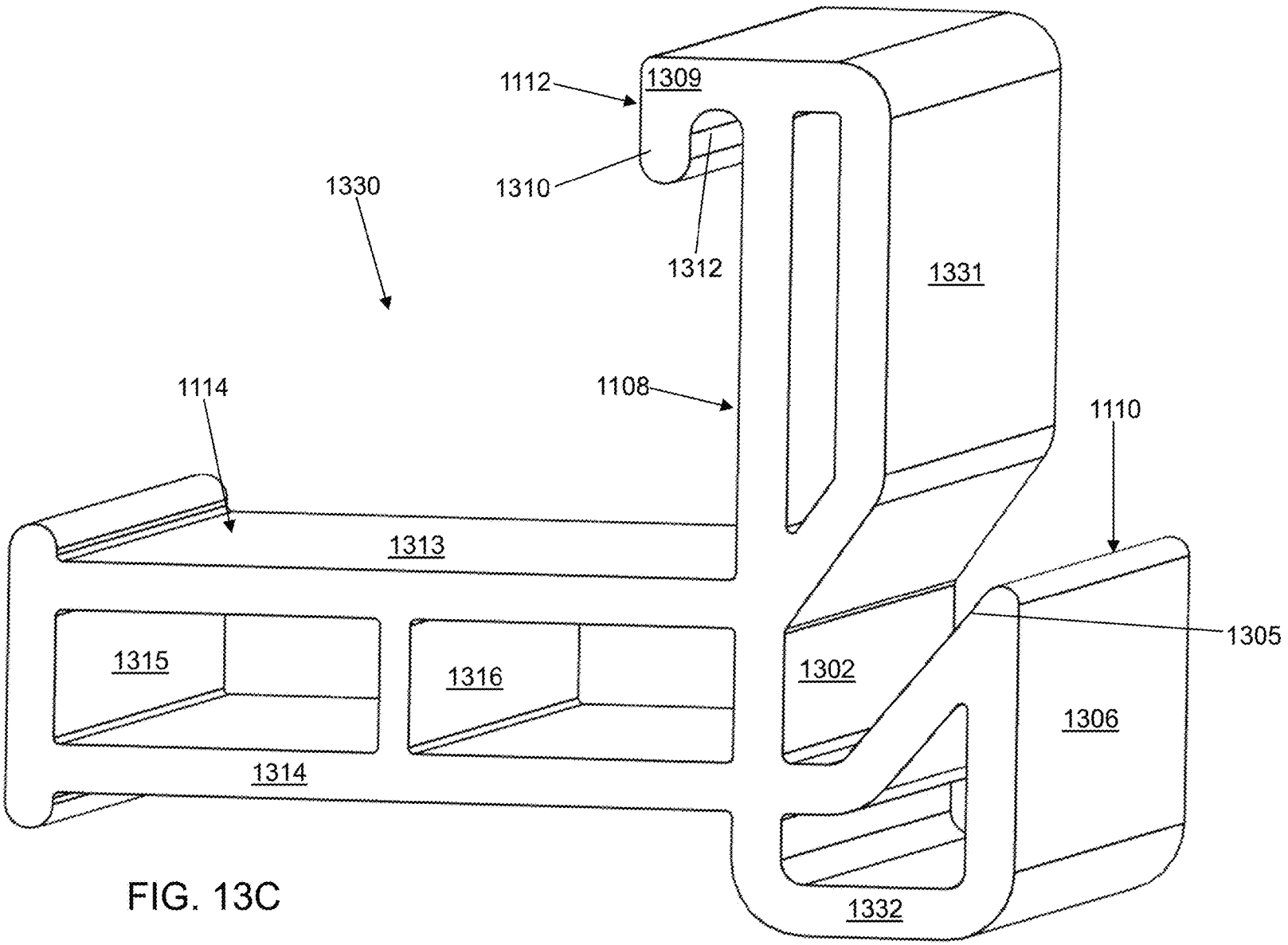
FIG. 13C depicts a perspective view of a third liner hanger of the cabinet of FIG. 2 in accordance with an illustrative embodiment.

Referring to FIG. 13C, a perspective view of a third hanger 1330 of cabinet 200 is shown in accordance with an illustrative embodiment. Third hanger 1330 may be used as first liner hanger 406, second liner hanger 408, third liner hanger 602, and/or fourth liner hanger 604. As described above, third hanger 1330 may include hanger body 1108, hanger liner mating portion 1110, hanger retainer mating portion 1112, and hanger brace portion 1114. Hanger retainer mating portion 1112 and hanger brace portion 1114 of third hanger 1330 have a similar shape to hanger retainer mating portion 1112 and hanger brace portion 1114 of first hanger 1300.

In the illustrative embodiment of FIG. 13C, hanger body 1108 may include main body wall 1302 and a second body wall 1331 that provide a frame to which hanger liner mating portion 1110, hanger retainer mating portion 1112, and hanger brace portion 1114 are mounted. Second body wall 1331 extends from the first face of main body wall 1302 to add strength and rigidity to hanger body 1108 of third hanger 1330.

In the illustrative embodiment of FIG. 13C, hanger liner mating portion 1110 may include first liner abutment wall 1305, support wall 1306, and an extension wall 1332. Support wall 1306 extends between the edge of first liner abutment wall 1305 and extension wall 1332. Extension wall 1332 extends between an edge of main body wall 1302 and an edge of support wall 1306.

Figure 13D:
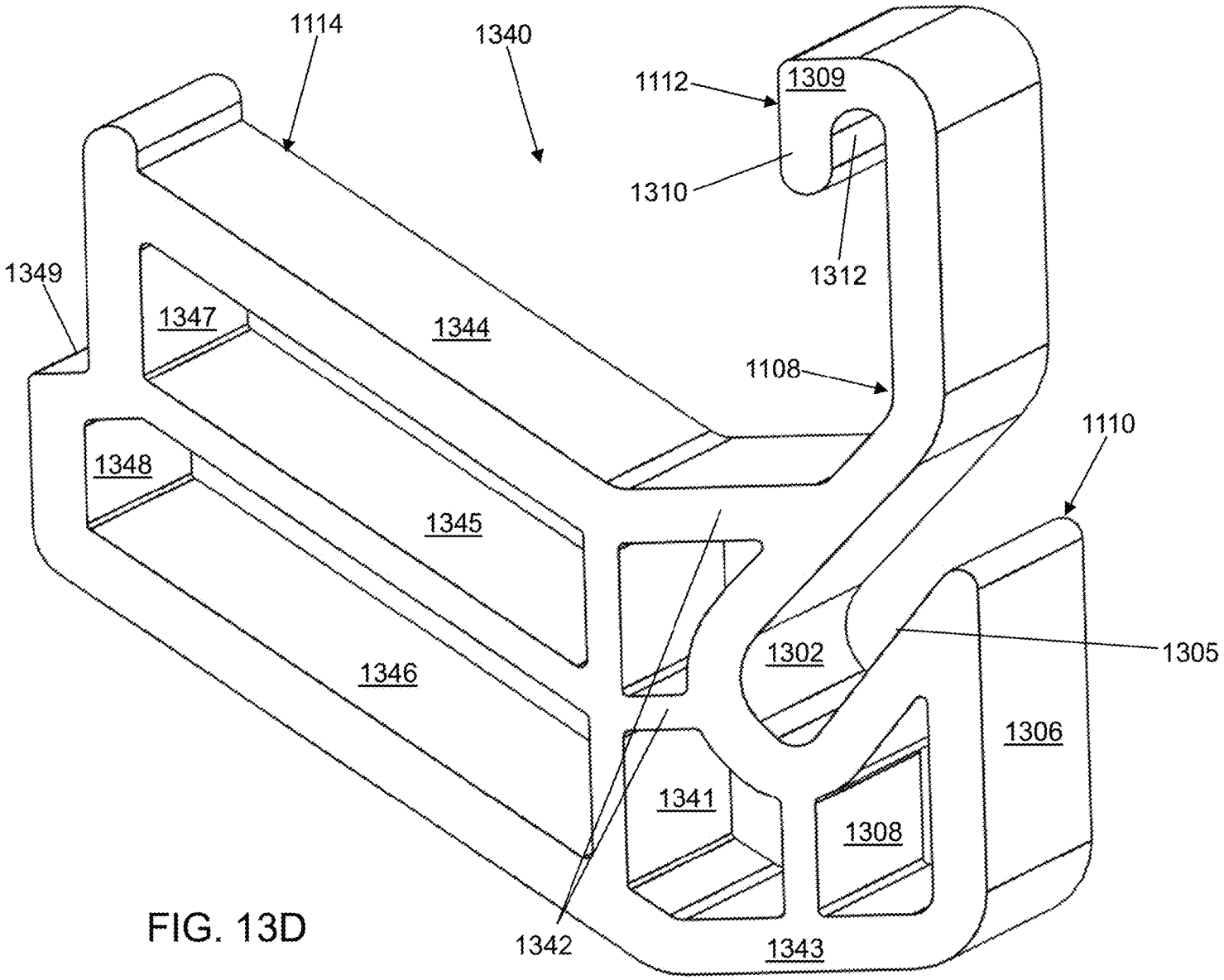
FIG. 13D depicts a perspective view of a fourth liner hanger of the cabinet of FIG. 2 in accordance with an illustrative embodiment.

Referring to FIG. 13D, a perspective view of a fourth hanger 1340 of cabinet 200 in accordance with an illustrative embodiment. Fourth hanger 1340 may be used as first liner hanger 406, second liner hanger 408, third liner hanger 602, and/or fourth liner hanger 604. As described above, fourth hanger 1340 may include hanger body 1108, hanger liner mating portion 1110, hanger retainer mating portion 1112, and hanger brace portion 1114. Hanger retainer mating portion 1112 of fourth hanger 1340 has a similar shape to hanger retainer mating portion 1112 of first hanger 1300.

In the illustrative embodiment of FIG. 13D, hanger body 1108 may include main body wall 1302, a second body wall 1341, and a plurality of ribs 1342 that extend between main body wall 1302 and second body wall 1341 to provide a frame to which hanger liner mating portion 1110, hanger retainer mating portion 1112, and hanger brace portion 1114 are mounted. In the illustrative embodiment of FIG. 13D, main body wall 1302 is curved. Second body wall 1341 and the plurality of ribs 1342 extend from the first face of main body wall 1302. Second body wall 1341 and the plurality of ribs 1342 add strength and rigidity to hanger body 1108 of fourth hanger 1340.

In the illustrative embodiment of FIG. 13D, hanger liner mating portion 1110 may include first liner abutment wall 1305, support wall 1306, an extension wall 1343, and rib 1308. Support wall 1306 extends between an edge of first liner abutment wall 1305 and extension wall 1343. Extension wall 1343 extends between an edge of second body wall 1341 and the edge of support wall 1306. Rib 1308 is formed below a channel formed by first liner abutment wall 1305 and main body wall 1302. Rib 1308 is formed between the channel and extension wall 1343 to add strength and rigidity to hanger liner mating portion 1110 of fourth hanger 1340.

In the illustrative embodiment of FIG. 13D, hanger brace portion 1114 may include a first brace wall 1344, a second brace wall 1345, a third brace wall 1346, an abutment wall 1347, and a rib 1348. First brace wall 1344, second brace wall 1345, and third brace wall 1346 are parallel and extend from a second face of second body wall 1341. Abutment wall 1347 is mounted between edges of first brace wall 1344 and second brace wall 1345 opposite the second face of second body wall 1341. Rib 1348 is mounted between edges of second brace wall 1345 and third brace wall 1346 opposite the second face of second body wall 1341. Rib 1348 is offset from abutment wall 1347 to form a ledge 1349 there between.

Figure 14:
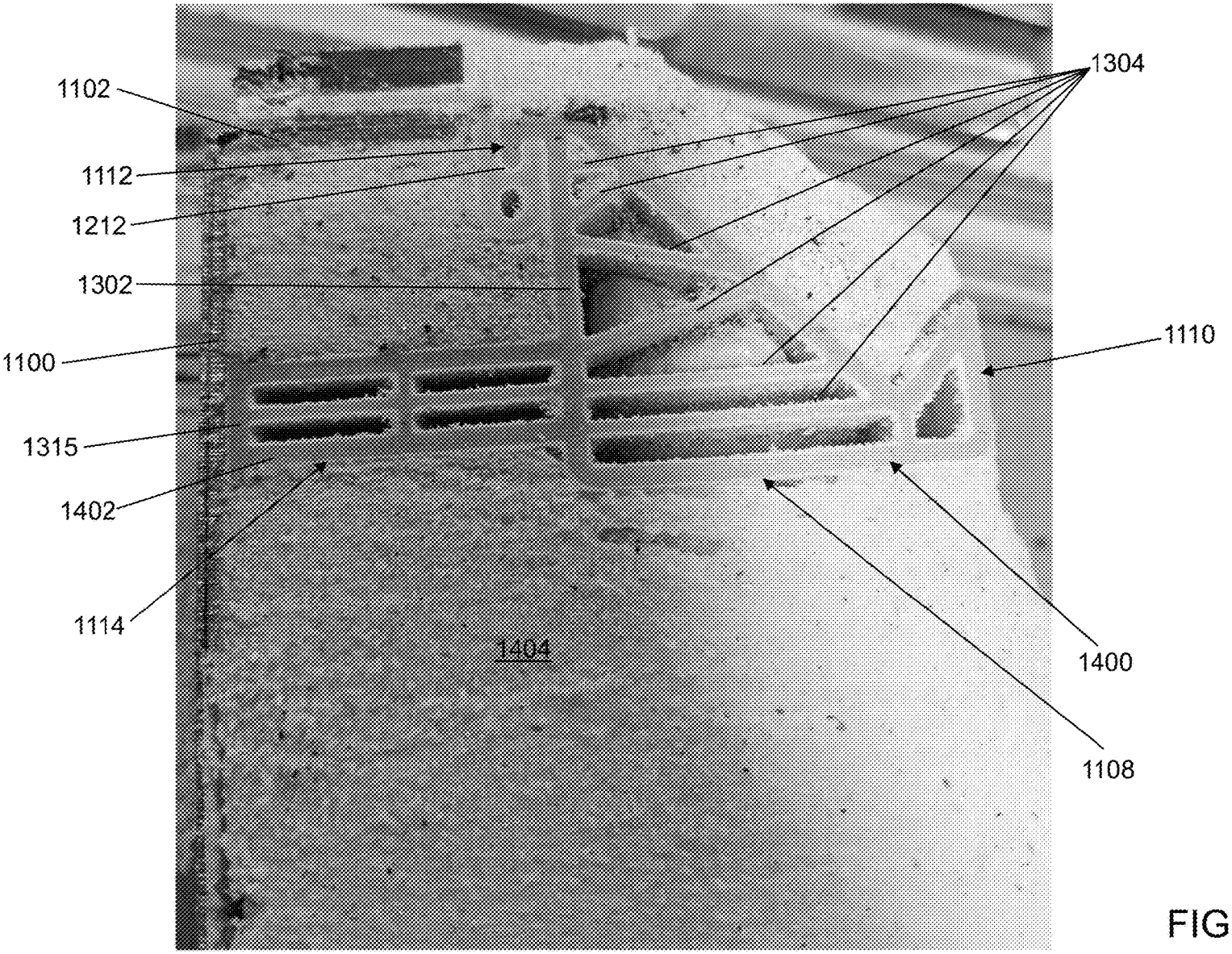
FIG. 14 depicts a perspective view of a fifth liner hanger foamed into the cabinet of FIG. 2 in accordance with an illustrative embodiment.

Referring to FIG. 14, a perspective view of a fifth hanger 1400 is shown foamed into cabinet 200 in accordance with an illustrative embodiment. Fifth hanger 1400 may be used as first liner hanger 406, second liner hanger 408, third liner hanger 602, and/or fourth liner hanger 604. As described above, fifth hanger 1400 may include hanger body 1108, hanger liner mating portion 1110, hanger retainer mating portion 1112, and hanger brace portion 1114. Hanger retainer mating portion 1112 and hanger brace portion 1114 of third hanger 1330 have a similar shape to hanger retainer mating portion 1112 and hanger brace portion 1114 of first hanger 1300. Hanger body 1108 of fifth hanger 1400 has a similar shape to hanger body 1108 of first hanger 1300 except including additional ribs in the plurality of ribs 1304. Hanger brace portion 1114 of fifth hanger 1400 has a similar shape to hanger brace portion 1114 of first hanger 1300 except including a third brace wall 1402 that extends from the second face of main body wall 1302 between abutment wall 1315 and main body wall 1302. Insulating foam 1404 has been blown into the cavity between liner 404 and the shell exterior walls.

Figure 15:
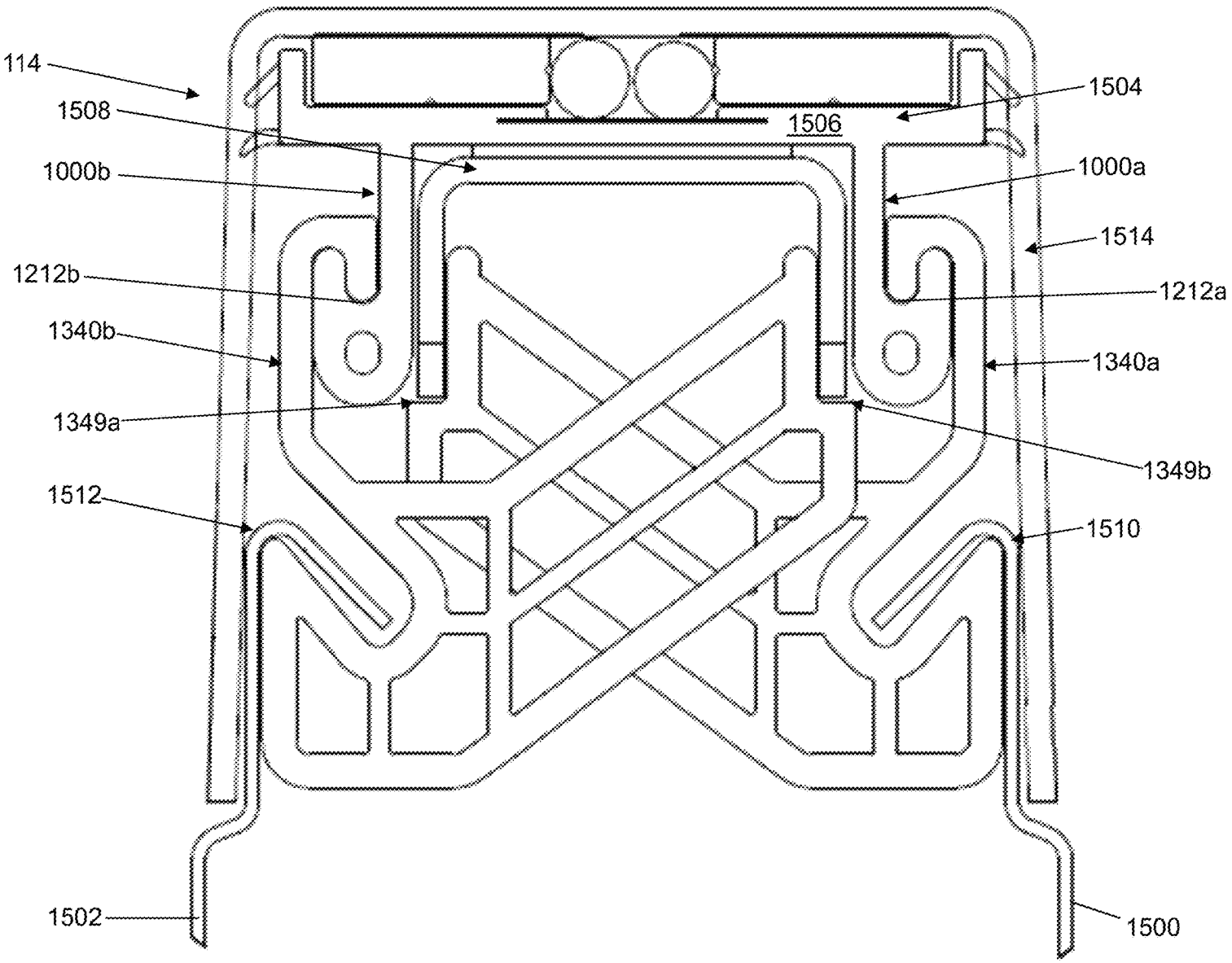
FIG. 15 depicts a top view of the fourth liner hanger mounted to an inner wall of the refrigerator of FIG. 1 in accordance with an illustrative embodiment.

Referring to FIG. 15, a top view of a first, fourth hanger 1340*a* and a second, fourth hanger 1340*b* is shown mounted to divider wall 114 of refrigerator 100 in accordance with an illustrative embodiment. Divider wall 114 may include a first liner wall 1500 and a second liner wall 1502. First liner wall 1500 may define a liner wall of the first compartment, and second wall 1502 may define a liner wall of the second compartment. First, fourth hanger 1340*a* and second, fourth hanger 1340*b* are instances of fourth hanger 1340 mounted rotated 180 degrees with respect to each other. A center retainer tube 1504 is similar to retainer tube 1200 except center retainer tube 1504 may include a tube body 1506, a first retainer hook portion 1000*a*, and a second retainer hook portion 1000*b*. First retainer hook portion 1000*a* may include a first hook channel 1212*a*, and second retainer hook portion 1000*b* may include a second hook channel 1212*b*.

A mullion support bar 1508 is mounted between first retainer hook portion 1000*a* and second retainer hook portion 1000*b*. A first edge of mullion support bar 1508 abuts first ledge 1349*a* of first, fourth hanger 1340*a*, and a second edge of mullion support bar 1508 abuts second ledge 1349*b* of second, fourth hanger 1340*b*.

A first wall liner abutment wall 1510 extends from an interior edge of first liner wall 1500. First wall liner abutment wall 1510 forms a surface for mounting to first, fourth hanger 1340*a*. In the illustrative embodiment, first wall liner abutment wall 1510 forms a v-shaped valley though first wall liner abutment wall 1510 may form a ∪-shaped valley, an Γ-shaped valley, etc. on which first liner wall 1500 is mounted to first, fourth hanger 1340*a*.

A second wall liner abutment wall 1512 extends from an interior edge of second liner wall 1502. Second wall liner abutment wall 1512 forms a surface for mounting to second, fourth hanger 1340*b*. In the illustrative embodiment, second wall liner abutment wall 1512 forms a v-shaped valley though second wall liner abutment wall 1512 may form a ∪-shaped valley, an Γ-shaped valley, etc. on which second liner wall 1502 is mounted to second, fourth hanger 1340*b*.

A center face frame 1514 extends around an end between first liner wall 1500 and a second liner wall 1502 of divider wall 114 of refrigerator 100.

When mounted between a pair of walls, each hanger 1300, 1330, 1340, 1400 prevents significant rotation and deflection and includes ribs and walls that are spaced throughout to provide support while allowing insulating foam 1404 to flow through and around each hanger, ensuring proper insulation of the walls of refrigerator 100. Each hanger 1300, 1330, 1340, 1400 maintains a consistent distance between the pair of walls. A length, depth, and width of each hanger 1300, 1330, 1340, 1400 may be selected to span a gap or cavity formed between the pair of walls with a number of ribs and other walls selected to provide a strength and rigidity sufficient to maintain the separation distance while allowing insulating foam to flow there through.

Figure 16:
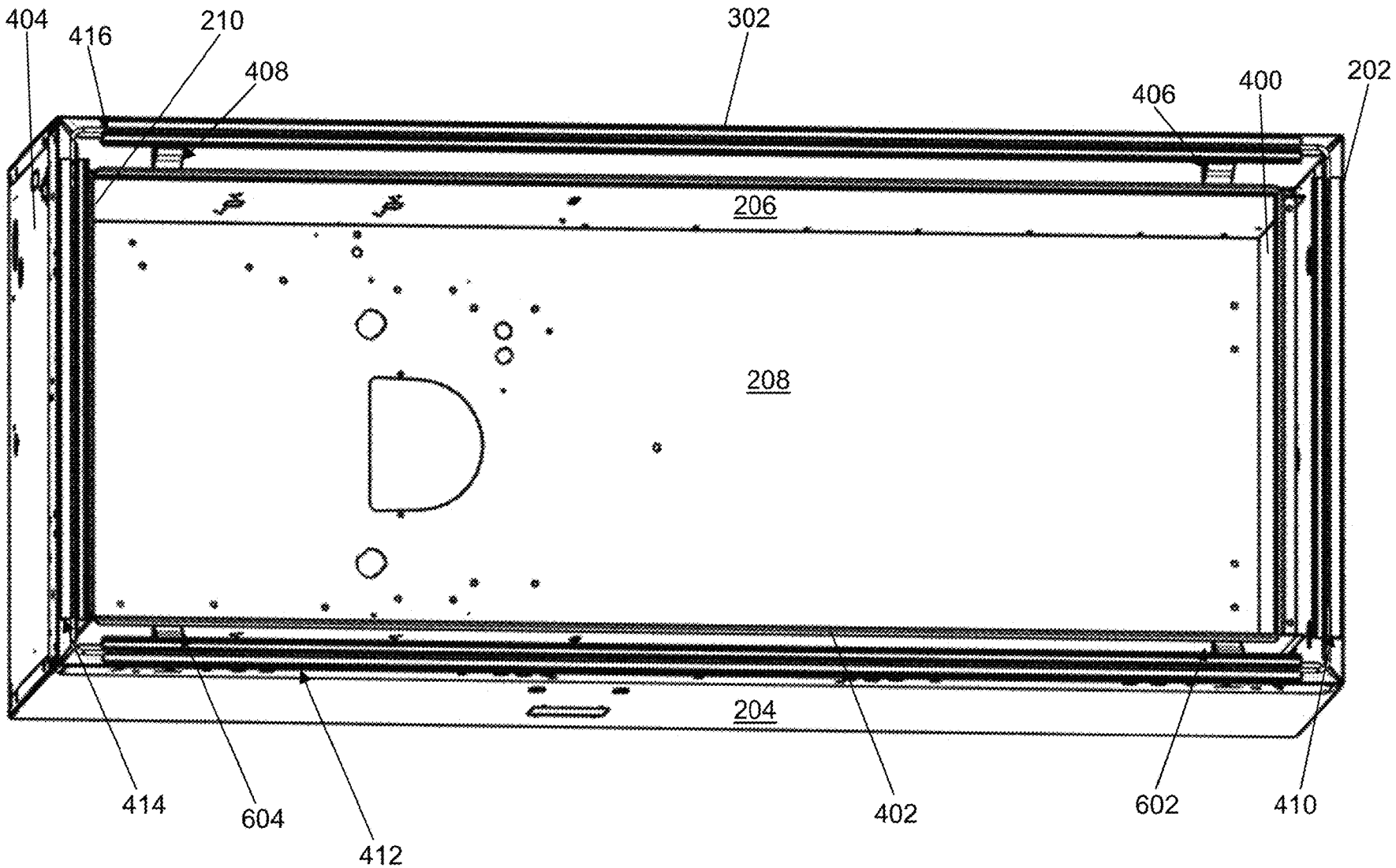
FIG. 16 depicts a bottom, front perspective view of the cabinet of FIG. 2 with the face frame removed in accordance with an illustrative embodiment.
Figure 17:
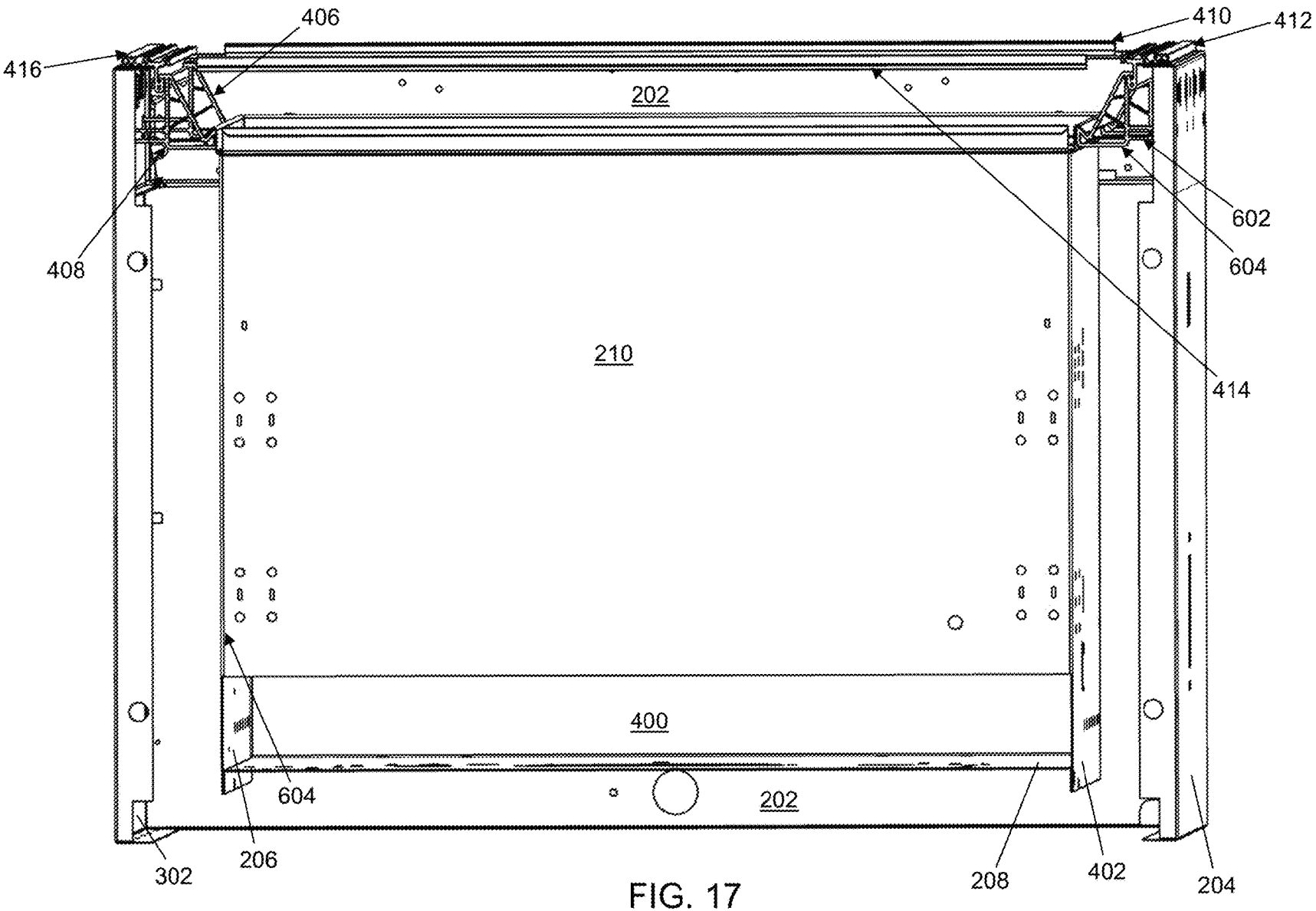
FIG. 17 depicts a bottom, right perspective view of the cabinet of FIG. 2 with the face frame, the shell exterior bottom wall, and a shell exterior back wall removed in accordance with an illustrative embodiment.

Referring to FIG. 16, a bottom, front perspective view is shown of cabinet 200 with face frame 212 removed in accordance with an illustrative embodiment. Referring to FIG. 17, a bottom, right perspective view is shown of cabinet 200 with face frame 212, shell exterior bottom wall 404, and shell exterior back wall 420 removed in accordance with an illustrative embodiment. The gap or cavity formed between the pair of walls is shown that is spanned by first liner hanger 406, second liner hanger 408, third liner hanger 602, and fourth liner hanger 604 for illustration.

Gravity may be used to keep components in position prior to foaming. Cabinet 200 may be positioned face-up (on its back) as shown referring to FIGS. 16 and 17 for illustration. First liner hanger 406, second liner hanger 408, third liner hanger 602, and fourth liner hanger 604 are positioned on a respective retainer tube 1200 to abut the shell exterior walls and to define a position for liner 404 in a z-direction that extends from a back to a front of cabinet 200. Liner 404 is dropped into a shell defined by the shell exterior walls and hung on hanger liner mating portion 1110 of first liner hanger 406, second liner hanger 408, third liner hanger 602, and fourth liner hanger 604, in an illustrative embodiment.

First liner hanger 406, second liner hanger 408, third liner hanger 602, and fourth liner hanger 604 eliminate the need for toadstools or breaker strips to locate and secure liner 404 within cabinet 200 for foaming. First liner hanger 406, second liner hanger 408, third liner hanger 602, and fourth liner hanger 604 provide a rigid surface to press on during adherence of face frame 212 to liner 404. First liner hanger 406, second liner hanger 408, third liner hanger 602, and fourth liner hanger 604 may be positioned at multiple locations such as in the four corners as shown, for example, referring to FIGS. 16 and 17. Because first liner hanger 406, second liner hanger 408, third liner hanger 602, and fourth liner hanger 604 are not continuous strips, thermal bridging is reduced.

First liner hanger 406, second liner hanger 408, third liner hanger 602, and fourth liner hanger 604 are not visible to the end-user, providing an aesthetic benefit, and reduce an unwanted visible gap between face frame 212 and liner 404 after foaming in the insulation. First liner hanger 406, second liner hanger 408, third liner hanger 602, and fourth liner hanger 604 improve a dimensional capability in the foamed cabinet and allow liner back wall 208 to "float" (depth position remains flexible) prior to foaming, so that the depth between liner back wall 208 and shell back wall 420 is controlled using a foam plug (not shown), reducing a tolerance stack-up.

Though described as including multiple portions, hanger 1300, 1330, 1340, 1400 may be a single continuous piece of material, for example, by molding, or may be formed of multiple distinct pieces mounted together, for example, attached to each other using various fasteners including adhesives, screws, rivets, etc.

The materials used to form the pair of walls may be metal, wood, plastic, etc. The components of refrigerator 100 may be formed of one or more materials, such as metals, glass, and/or plastics having a sufficient strength and rigidity and aesthetic value to provide the illustrated and/or described function.

Though described herein as forming an insulated wall or an insulated door of a refrigerator, the insulated wall may be included in other items including a wall of a drawer, a wall of a room, such as a cold storage room, a wall of a vehicle, such as a refrigerated truck, etc.

As used in this disclosure, the term "mount" is intended to define a structural connection between two or more elements and includes join, unite, connect, couple, associate, insert, hang, hold, affix, attach, fasten, bind, paste, secure, bolt, screw, rivet, solder, weld, glue, adhere, form over, layer, and other similar terms. The phrases "mounted on" and "mounted to" include any interior or exterior portion of the elements referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A liner hanger comprising:

a body wall including a first face and a second face, wherein the second face is on an opposite side of the body wall relative to the first face;

a first hook wall mounted to the first face of the body wall to form a first hook channel;

a second hook wall mounted to the second face of the body wall to form a second hook channel;

a brace wall including a first end and a second end, wherein the second end is on an opposite end of the brace wall relative to the first end, wherein the first end is mounted to the first face of the body wall;

a second brace wall including a third end and a fourth end, wherein the fourth end is on an opposite end of the second brace wall relative to the third end, wherein the third end is mounted to the first face of the body wall; and an abutment wall mounted to the second end of the brace wall and the fourth end of the second brace wall.

2. The liner hanger of claim 1, wherein the brace wall and the second brace wall include a curve.

3. The liner hanger of claim 1, wherein the second brace wall extends parallel to the brace wall.

4. The liner hanger of claim 1, wherein a rib wall is mounted between the brace wall and the second brace wall.

5. The liner hanger of claim 1, wherein the abutment wall extends from the second end of the brace wall to the fourth end of the second brace wall.

6. The liner hanger of claim 1, further comprising a third brace wall including a fifth end and a sixth end, wherein the sixth end is on an opposite end of the third brace wall relative to the fifth end, wherein the fifth end is mounted to the first face of the body wall, wherein the abutment wall is further mounted to the sixth end of the third brace wall.

7. The liner hanger of claim 6, wherein the abutment wall extends from the second end of the brace wall to the fourth end of the second brace wall to the sixth end of the third brace wall.

8. The liner hanger of claim 1, wherein at least a portion of the first hook channel has a ∪-shape.

9. The liner hanger of claim 1, wherein at least a portion of the first hook channel has a v-shape.

10. The liner hanger of claim 1, wherein at least a portion of the second hook channel has a ∪-shape.

11. The liner hanger of claim 1, wherein at least a portion of the second hook channel has a v-shape.

12. The liner hanger of claim 1, wherein at least a portion of the body wall is curved.

13. The liner hanger of claim 1, further comprising a support wall including a third end and a fourth end, wherein the fourth end of the support wall is on an opposite end of the support wall relative to the third end of the support wall, wherein the third end of the support wall is mounted to extend from the second hook channel, wherein the fourth end of the support wall is mounted to an edge of the second hook wall.

14. The liner hanger of claim 13, wherein the third end of the support wall is mounted to extend from a base of the second hook channel.

15. The liner hanger of claim 1, further comprising a support wall including a third end and a fourth end, wherein the fourth end of the support wall is on an opposite end of the support wall relative to the third end of the support wall, wherein the third end of the support wall is mounted to the second face of the body wall opposite the first hook wall, wherein the fourth end of the support wall is mounted to the second hook wall.

16. The liner hanger of claim 15, further comprising a rib wall including a fifth end and a sixth end, wherein the sixth end is on an opposite end of the rib wall relative to the fifth end, wherein the fifth end is mounted to the second face of the body wall, wherein the sixth end is mounted to the support wall.

17. An insulated wall comprising:

a first wall configured to form a first hook channel;

a second wall configured to form a second hook channel;

a third wall;

a liner hanger comprising a body wall including a first face and a second face, wherein the second face is on an opposite side of the body wall relative to the first face;

a first hook wall mounted to the first face of the body wall to form a third hook channel, wherein the first hook wall is mounted to the first hook channel of the first wall;

a second hook wall mounted to the second face of the body wall to form a fourth hook channel, wherein the second hook wall is mounted to the second hook channel of the second wall;

a brace wall including a first end and a second end, wherein the second end is on an opposite end of the brace wall relative to the first end, wherein the first end is mounted to the first face of the body wall; and an abutment wall mounted to the second end of the brace wall, wherein the abutment wall is mounted to abut the third wall; and insulating foam mounted between the first wall, the second wall, and the third wall surrounding the liner hanger.

18. The insulated wall of claim 17, wherein the first wall is mounted to the third wall to extend perpendicular relative to the third wall.

19. The insulated wall of claim 17, wherein the liner hanger is configured to maintain a separation between the second wall and the third wall.

20. The insulated wall of claim 17, further comprising:

a second liner hanger comprising a second body wall including a third face and a fourth face, wherein the fourth face is on an opposite side of the second body wall relative to the third face;

a third hook wall mounted to the third face of the second body wall to form a fifth hook channel, wherein the third hook wall is mounted to the first hook channel of the first wall;

a fourth hook wall mounted to the fourth face of the second body wall to form a sixth hook channel, wherein the fourth hook wall is mounted to the second hook channel of the second wall;

a second brace wall including a third end and a fourth end, wherein the fourth end is on an opposite end of the second brace wall relative to the third end, wherein the third end is mounted to the third face of the second body wall; and a second abutment wall mounted to the fourth end of the second brace wall, wherein the second abutment wall is mounted to abut the third wall.

* * * * *